US012703828B2

(12) United States Patent
Akah et al.

(10) Patent No.: US 12,703,828 B2
(45) Date of Patent: Aug. 11, 2026

(54) PROCESS FOR THE CONVERSION OF HYDROCARBONS TO OLEFINS

(71) Applicants: Saudi Arabian Oil Company, Dhahran (SA); King Fahd University of Petroleum and Minerals, Dhahran (SA)

(72) Inventors: Aaron Chi Akah, Dhahran (SA); Mansour Ali Al Herz, Al Ahsa (SA); Qi Xu, Dhahran (SA); Ziyauddin S. Qureshi, Dhahran (SA); Abdullah Mohammed Aitani, Khobar (SA); Mohammed Abdul Bari Siddiqui, Dhahran (SA)

(73) Assignees: Saudi Arabian Oil Company, Dhahran (SA); King Fahd University of Petroleum and Minerals, Dhahran (SA)

( * ) Notice: Subject to any disclaimer, the term of this patent is extended or adjusted under 35 U.S.C. 154(b) by 185 days.

(21) Appl. No.: 18/402,371

(22) Filed: Jan. 2, 2024

(65) Prior Publication Data

US 2025/0215334 A1 Jul. 3, 2025

(51) Int. Cl.
*C10G 47/20* (2006.01)

(52) U.S. Cl.
CPC ..... *C10G 47/20* (2013.01); *C10G 2300/4006* (2013.01); *C10G 2300/4012* (2013.01); *C10G 2300/703* (2013.01); *C10G 2400/20* (2013.01)

(58) Field of Classification Search
CPC ..... C10G 47/20; C10G 2300/4006; C10G 2300/4012; C10G 2300/703; C10G 2400/20; C10G 11/05; B01J 2235/15; B01J 2235/30; B01J 29/46
See application file for complete search history.

(56) References Cited

U.S. PATENT DOCUMENTS

| | | | | |
|---|---|---|---|---|
| 2009/0326299 | A1 | 12/2009 | Tissler et al. | |
| 2022/0098493 | A1* | 3/2022 | Akah | B01J 38/16 |
| 2022/0267681 | A1* | 8/2022 | Singh | B01J 27/16 |

FOREIGN PATENT DOCUMENTS

| | | | |
|---|---|---|---|
| WO | 2008147546 | A1 | 12/2008 |
| WO | 2018117820 | A1 | 6/2018 |

OTHER PUBLICATIONS

Akah et al., "An Overview of Light Olefins Production via Steam Enhanced Catalytic Cracking", Catalysis Surveys from Asia, vol. 23, No. 4, ISSN1571-1013, 2019.

(Continued)

*Primary Examiner* — Michelle Stein
(74) *Attorney, Agent, or Firm* — Dinsmore & Shohl LLP

(57) ABSTRACT

A method for converting hydrocarbons in a hydrocarbon stream includes contacting the hydrocarbon stream with steam and a catalyst system under steam enhanced catalytic cracking conditions to produce an effluent comprising olefins. The catalyst system includes a framework-substituted pentasil zeolite. The framework-substituted pentasil zeolite has a modified pentasil framework. The modified pentasil framework includes a pentasil aluminosilicate framework in which a portion of framework aluminum atoms of the pentasil aluminosilicate framework are substituted with Ce atoms and Fe atoms. At least a portion of the Fe atoms are monomeric.

15 Claims, 12 Drawing Sheets

(56) References Cited

OTHER PUBLICATIONS

ASTM International, "Standard Test Method for Boiling Range Distribution of Petroleum Fracctions by Gas Chromatography", D-2887, American Society for Testing & Materials (ASTM), 2018.
Barghi et al., "Modeling of ZnZSM-5 deactivation during liquefied petroleum gas catalytic cracking in the presenceof steam", Reaction Kinetics, Metchanism and Catalysis vol. 120, pp. 753-773, 2017.
Corma et al., "Steam catalytic cracking of naphtha over ZSM-5 zeolite for production of propene and ethene: Micro and Macroscopic implications of the presence of steam", Applied Catalysis A: General, 417-418, pp. 220-235, 2012.
Corma et al., "IM-5 zeolite for steam catalytic cracking of naphtha to produce propene and ethene. An alternative to ZSM-5 zeolite", Applied Catalysis A: General, 460-461, pp. 106-115, 2013.
Dharia et al., "Catalytic Cracking for Integration of Refinery and Steam Crackers", Advances in Fluid Catalytic Cracking: Testing, Characterization & Environmental Regulations, Occelli, M, Ed. CRC Press, New York, pp. 119-126, 2010.
Fumoto et a., "Iron oxide-based catalyst for catalytic cracking of heavy oil", Iron Ores and Iron Oxide Materials, Ed. V. Shatokha, IntechOpen, London, pp. 93-110, 2018.
Ghashghaee et al., "Steam catalytic cracking of fuel oil over a novel composite nanocatalyst: Characterization, kinetics and comparative perspective", Journal of Analytical and Applied Pyrolysis, vol. 138, pp. 281-293, 2019.
Gugel, "Introducing the refinery of the future", Hydrocarbon Processing, Issue No. 3, pp. 12-17, 2019.
Lee, "Petrochemicals—The Growth Area That Refiners Will Need", Presented at the Asian Petrochemical Industry Conference (APIC), Taipei, May 2019.
Meng et al., "Studies on catalytic pyrolysis of heavy oils: Reaction behaviors and methanistic pathways", Applied Catalysis A: General, vol. 294, pp. 168-176, 2005.
Mukherjee, "Kbr Olefins Technology-Technology options to meet uncertain market conditions", Presented at the 4th Petrochemicals Conclave, Delhi, 36 pages, Feb. 12, 2015.
Tallman et al., "Consider new catalytic routes for olefins production", Hydrocarbon Proc. vol. 87, No. 4, pp. 95-101, 2008.
Yao et al., "Preparation of Ce—Mn/Fe2O3 Catalysts for Steam Catalytic Cracking of Coal Tar", Chemistry Select, vol. 3, pp. 12537-12543, 2018.
Zhu, et al., "Research and Commercial Application of CPP Technology for Producing Light Olefins from Heavy Oil", China Petroleum Processing and Petrochemical Technology, vol. 15, No. 3, pp. 7-12, 2013.
Notification of Transmittal of the International Search Report and the Written Opinion of the International Searching Authority, or the Declaration dated Feb. 19, 2025 pertaining to International application No. PCT/US2024/054822 filed Nov. 7, 2024, pp. 1-13.
Ghazimoradi, Maryam et al: "Effect of simultaneous dealumination and metal incorporation of zeolite ZSM-5 on the catalytic performance in HTO process", Microporous and Mesoporous Materials, Mar. 1, 2023, 112486, pp. 1-11, vol. 351, Amsterdam ,NL.

* cited by examiner

PROCESS FOR THE CONVERSION OF HYDROCARBONS TO OLEFINS

BACKGROUND

Field

The disclosure generally relates to processes and systems for conversion of hydrocarbons to olefins. More specifically, the disclosure relates to processes and systems for steam enhanced catalytic cracking of crude oil to obtain light olefin products.

Technical Background

The worldwide increasing demand for greater value petrochemical products and chemical intermediates remains a major challenge for many integrated refineries. In particular, the production of some valuable light olefins, such as ethylene and propylene, has attracted increased attention as pure olefin streams are considered the building blocks for polymer synthesis. Additionally, light aromatic compounds, such as benzene, toluene, and mixed xylenes can be useful as fuel blending constituents or can be converted to greater value chemical products and intermediates, which can be used as building blocks in chemical synthesis processes. Petrochemical feeds, such as crude oils, can be converted to petrochemicals, such as fuel blending components and chemical products and intermediates, such as light olefins and aromatic compounds, which are basic intermediates for a large portion of the petrochemical industry. Crude oil is conventionally processed by distillation followed by various reforming, solvent treatments, and hydroconversion processes to produce a desired slate of fuels, lubricating oil products, chemicals, chemical feedstocks, and the like. Conventional refinery systems generally combine multiple complex refinery units with petrochemical plants to produce greater value petrochemical products and intermediates.

SUMMARY

Accordingly, there is an ongoing need for cracking catalysts and processes for steam enhanced catalytic cracking of crude oil feeds and other hydrocarbon feeds to produce greater yields of light olefins, light aromatic compounds, or both. The present disclosure is directed to a cracking catalyst comprising a framework-substituted pentasil zeolite catalyst and a method of preparing the framework-substituted pentasil zeolite, which includes mixing a pentasil aluminosilicate framework with an iron precursor and a cerium precursor to form a first mixture, which is a solid mixture, and calcining the first mixture. The framework-substituted pentasil zeolite may comprise monomeric iron, monomeric cerium, or both. The present disclosure is further directed to processes of converting hydrocarbon feeds, such as but not limited to crude oil, to produce greater value petrochemical products and intermediates through steam enhanced catalytic cracking of the hydrocarbon feeds in the presence of the framework-substituted pentasil zeolite to produce the greater value petrochemical products and intermediates, such as but not limited to light olefins, light aromatic compounds, or combinations of these. The processes and methods of the present disclosure can more efficiently convert crude oil and other hydrocarbon feeds to greater value petrochemical products and intermediates compared to other conventional refinery processes.

According to at least one aspect of the present disclosure, a method for converting hydrocarbons in a hydrocarbon stream may include contacting the hydrocarbon stream with steam and a catalyst system under steam enhanced catalytic cracking conditions to produce an effluent comprising olefins. The catalyst system may comprise a framework-substituted pentasil zeolite. The framework-substituted pentasil zeolite may have a modified pentasil framework. The modified pentasil framework may comprise a pentasil aluminosilicate framework wherein a portion of framework aluminum atoms of the pentasil aluminosilicate framework are substituted with Ce atoms and Fe atoms. At least a portion of the Fe atoms may be monomeric.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE SEVERAL VIEWS OF THE DRAWINGS

The following detailed description of the present disclosure may be better understood when read in conjunction with the following drawings in which.

Figure 1:
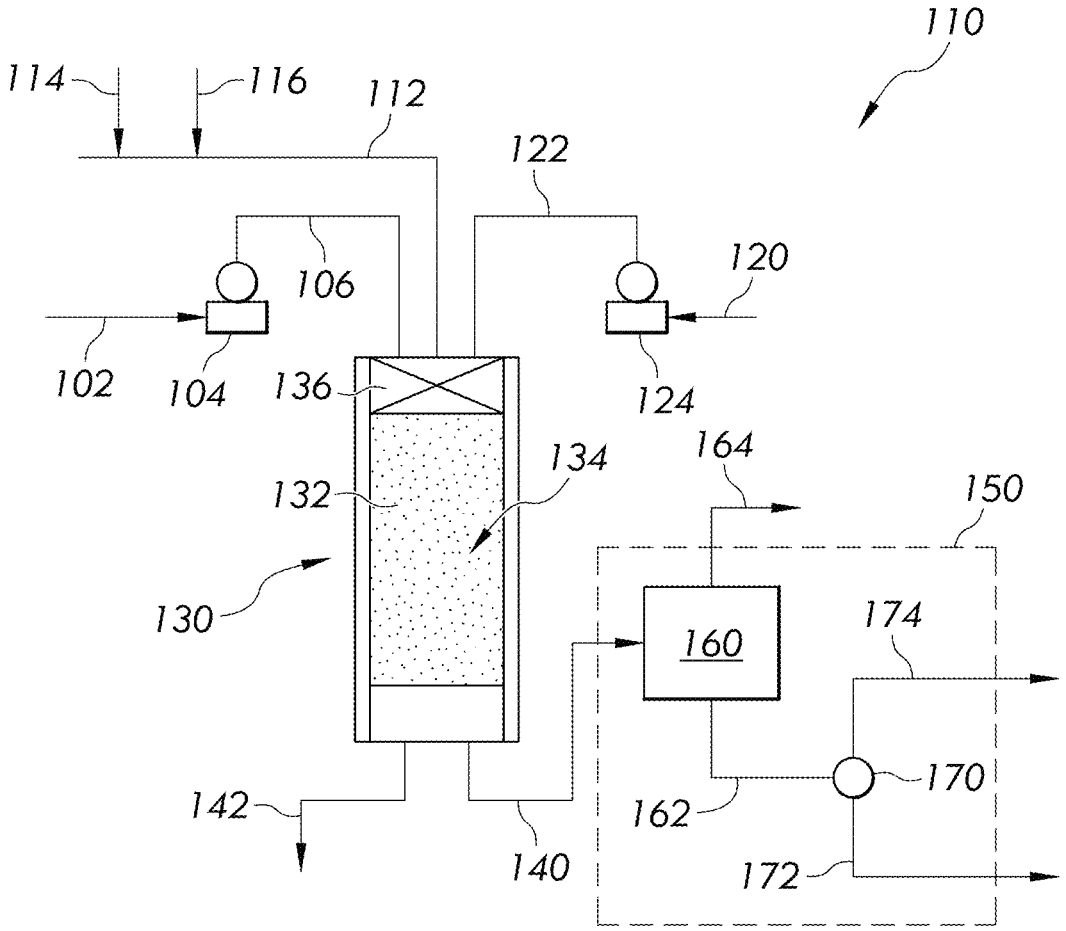
FIG. 1 schematically depicts a generalized flow diagram of a fixed bed reactor system for steam catalytic cracking of crude oil to produce olefins and aromatics, according to one or more embodiments shown and described in the present disclosure.
Figure 9:
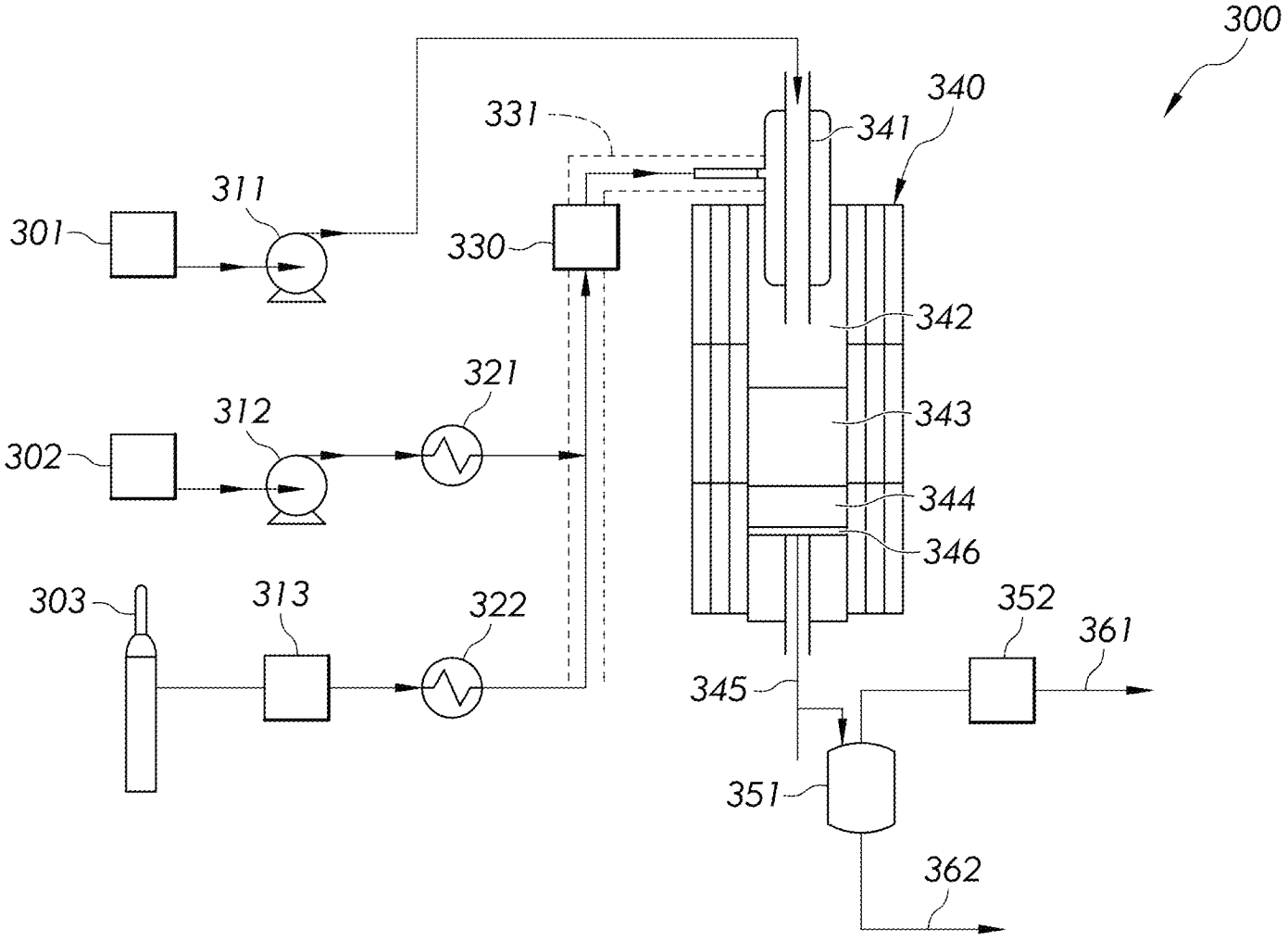
FIG. 9 schematically depicts a generalized flow diagram of a fixed bed reactor system for evaluating the cracking catalysts, according to one or more embodiments shown and described in the present disclosure.

When describing the simplified schematic illustrations of FIG. 1 and FIG. 9 the numerous valves, temperature sensors, electronic controllers, and the like, which may be used and are well known to a person of ordinary skill in the art, may not be included. Further, accompanying components that are often included in systems such as those depicted in FIG. 1 and FIG. 9, such as air supplies, heat exchangers, surge tanks, and the like also may not be included. However, a person of ordinary skill in the art understands that these components are within the scope of the present disclosure.

Additionally, the arrows in the simplified schematic illustrations of FIG. 1 and FIG. 9 refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustrations of FIG. 1 and FIG. 9 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Reference will now be made in greater detail to various aspects, some of which are illustrated in the accompanying drawings.

DETAILED DESCRIPTION

The present disclosure is directed to cracking catalysts and processes for steam enhanced catalytic cracking of crude oil to produce greater yields of light olefins, light aromatic compounds, or both. A process of the present disclosure for upgrading a hydrocarbon feed may include contacting the hydrocarbon feed with steam in the presence of a cracking catalyst at reaction conditions sufficient to cause at least a portion of hydrocarbons in the hydrocarbon feed to undergo one or more cracking reactions to produce a steam catalytic cracking effluent comprising light olefins, light aromatic compounds, or both. The cracking catalyst may comprise a framework-substituted pentasil zeolite. The framework-substituted pentasil zeolite may comprise cerium atoms and monomeric iron atoms substituted for framework aluminum atoms.

The framework-substituted pentasil zeolite may be produced by combining a pentasil aluminosilicate framework with an iron precursor and a cerium precursor, thereby forming a first mixture; and calcining the first mixture to produce the framework-substituted pentasil zeolite having the monomeric iron atoms substituted for framework aluminum atoms. Steam enhanced catalytic cracking of a hydrocarbon feed, such as but not limited to a crude oil, over a cracking catalyst comprising the framework-substituted pentasil zeolite of the present disclosure may improve the selectivity and yield of light olefins, light aromatic compounds, or both with less processing steps compared to conventional hydrocarbon refinery systems.

As used in the present disclosure, the term "cracking" refers to a chemical reaction where a molecule having carbon-carbon bonds is broken into more than one molecule by the breaking of one or more of the carbon-carbon bonds. As used in the present disclosure, the term "catalytic cracking" refers to cracking conducted in the presence of a catalyst. Some catalysts may have multiple forms of catalytic activity, and calling a catalyst by one particular function does not render that catalyst incapable of being catalytically active for other functionality.

As used in the present disclosure, the term "catalyst" refers to any substance that increases the rate of a specific chemical reaction, such as but not limited to cracking reactions.

As used in the present disclosure, the term "used catalyst" refers to catalyst that has been contacted with reactants at reaction conditions, but has not been regenerated in a regenerator or regenerated in place through a regeneration process. The "used catalyst" may have coke deposited on the catalyst and may include partially coked catalyst as well as fully coked catalysts. The amount of coke deposited on the "used catalyst" may be greater than the amount of coke remaining on the regenerated catalyst following regeneration. The "used catalyst" may also include catalyst that has a reduced temperature due to contact with the reactants compared to the catalyst prior to contact with the reactants.

As used in the present disclosure, the term "regenerated catalyst" refers to catalyst that has been contacted with reactants at reaction conditions and then regenerated in a regenerator or regenerated in place through a regeneration process to heat the catalyst to a greater temperature, oxidize and remove at least a portion of the coke or other organic contaminants from the catalyst to restore at least a portion of the catalytic activity of the catalyst, or both. The "regenerated catalyst" may have less coke or organic contaminants, a greater temperature, or both, compared to used catalyst and may have greater catalytic activity compared to used catalyst. The "regenerated catalyst" may have more coke and lesser catalytic activity compared to fresh catalyst that has not been contacted with reactants a cracking reaction zone and then regenerated.

As used throughout the present disclosure, the terms "butenes" or "mixed butenes" are used interchangeably and refer to combinations of one or a plurality of isobutene, 1-butene, trans-2-butene, or cis-2-butene. As used throughout the present disclosure, the term "normal butenes" refers to a combination of one or a plurality of 1-butene, trans-2-butene, or cis-2-butene. As used throughout the present disclosure, the term "2-butenes" refers to trans-2-butene, cis-2-butene, or a combinations of these.

As used in this disclosure, the term "initial boiling point" or "IBP" of a composition refers to the temperature at which the constituents of the composition with the least boiling point temperatures begin to transition from the liquid phase to the vapor phase. As used in this disclosure, the term "end boiling point" or "EBP" of a composition refers to the temperature at which the greatest boiling temperature constituents of the composition transition from the liquid phase to the vapor phase. A hydrocarbon mixture may be characterized by a distillation profile expressed as boiling point temperatures at which a specific weight percentage of the composition has transitioned from the liquid phase to the vapor phase.

As used in this disclosure, the term "atmospheric boiling point temperature" refers to the boiling point temperature of a compound at atmospheric pressure.

As used in this disclosure, the term "crude oil" or "whole crude oil" is to be understood to mean a mixture of petroleum liquids, gases, or combinations of liquids and gases, including, in embodiments, impurities such as but not limited to sulfur-containing compounds, nitrogen-containing compounds, and metal compounds, that have not undergone significant separation or reaction processes. Crude oils are distinguished from fractions of crude oil. In certain embodiments, the crude oil feedstock may be a minimally treated light crude oil to provide a crude oil feedstock having total metals (Ni+V) content of less than 5 parts per million by weight (ppmw) and Conradson carbon residue of less than 5 wt. %.

As used in the present disclosure, the term "directly" refers to the passing of materials, such as an effluent, from a first component of a processing system to a second component of the processing system without passing the materials through any intervening components or unit operations operable to change the composition of the materials. Similarly, the term "directly" also refers to the introducing of materials, such as a feed, to a component of the process system without passing the materials through any preliminary components operable to change the composition of the materials. Intervening or preliminary components or systems operable to change the composition of the materials include reactors and separators, but generally are not intended to include heat exchangers, valves, pumps, sensors, or other ancillary components required for operation of a chemical process.

As used in the present disclosure, the terms "downstream" and "upstream" refer to the positioning of components or unit operations of the processing system relative to a direction of flow of materials through the processing system. For example, a second component is considered "downstream" of a first component if materials flowing through the processing system encounter the first component before encountering the second component. Likewise, the first component is considered "upstream" of the second component if the materials flowing through the processing system encounter the first component before encountering the second component.

As used in the present disclosure, the term "effluent" refers to a stream that is passed out of a reactor, a reaction zone, or a separator following a particular reaction or separation. Generally, an effluent has a different composition than the stream that entered the reactor, reaction zone, or separator. It should be understood that when an effluent is passed to another component or system, only a portion of that effluent may be passed. For example, a slipstream may carry some of the effluent away, meaning that only a portion of the effluent may enter the downstream component or system. The terms "reaction effluent" and "reactor effluent" particularly refer to a stream that is passed out of a reactor or reaction zone.

The term "residence time" refers to the amount of time that reactants are in contact with a catalyst, at reaction conditions, such as at the reaction temperature.

The term "light olefins" refers to hydrocarbon compounds which include from 2 to 4 carbon atoms and at least one carbon-carbon double bond.

The term "light aromatic compounds" refers to aromatic compounds having a boiling point temperature in the naphtha boiling temperature range of from 25° C. to 221° C.

As used in the present disclosure, the term "reactor" refers to any vessel, container, conduit, or the like, in which one or more chemical reactions, such as but not limited catalytic cracking reactions, may occur between one or more reactants optionally in the presence of one or more catalysts. One or more "reaction zones" may be disposed within a reactor. The term "reaction zone" refers to a volume where a particular chemical reaction takes place in a reactor.

As used in the present disclosure, the terms "separation unit" and "separator" refer to any separation device(s) that at least partially separates one or more chemical constituents in a mixture from one another. For example, a separation system selectively separates different chemical constituents from one another, forming one or more chemical fractions. Examples of separation systems include, without limitation, distillation columns, fractionators, flash drums, knock-out drums, knock-out pots, centrifuges, decanters, filtration devices, traps, scrubbers, expansion devices, membranes, solvent extraction devices, adsorption devices, chemical separators, crystallizers, chromatographs, precipitators, evaporators, driers, high-pressure separators, low-pressure separators, or combinations or these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation can include only partial separation.

It should further be understood that streams may be named for the components of the stream, and the component for which the stream is named may be the major component of the stream (such as the component comprising the greatest fraction of the stream, excluding diluent gases, such as nitrogen, noble gases, and the like). It should also be understood that components of a stream are disclosed as passing from one system component to another when a stream comprising that component is disclosed as passing from that system component to another. For example, a disclosed "mixed butene stream" passing to a first system component or from a first system component to a second system component should be understood to equivalently disclose "mixed butenes" passing to the first system component or passing from a first system component to a second system component.

Conventional refinery systems include multiple unit operations. Steam enhanced catalytic cracking of crude oil directly can reduce the complexity of the refining process, such as by reducing the number of unit operations needed to process the crude oil. Steam enhanced catalytic cracking typically uses zeolites, which typically have a microporous pore structure having average pore size of less than 2 nanometers (nm). The present disclosure is directed to steam catalytic cracking of crude oil using a framework-substituted pentasil zeolite to convert the crude oil to greater value hydrocarbon products, such as but not limited to light olefins, aromatic compounds, or combinations of these. The framework-substituted pentasil zeolites of the present disclosure have a portion of the framework aluminum atoms being substituted by cerium atoms and monomeric iron atoms. The present disclosure is also directed to the framework-substituted pentasil zeolites and methods of making the framework-substituted pentasil zeolites.

Referring now to FIG. 1, a process 100 of the present disclosure for converting a hydrocarbon feed 102 to light olefins, light aromatic compounds, or both, includes contacting the hydrocarbon feed 102 with steam in the presence of a cracking catalyst 132 at reaction conditions sufficient to cause at least a portion of hydrocarbons in the hydrocarbon feed 102 to undergo one or more cracking reactions to produce a steam catalytic cracking effluent 140 comprising light olefins, light aromatic compounds, or both, where the cracking catalyst 132 comprises, consists of, or consists essentially of a framework-substituted pentasil zeolite.

The hydrocarbon feed 102 may include one or more heavy oils, such as but not limited to crude oil, bitumen, oil sand, shale oil, coal liquids, vacuum residue, tar sands, other heavy oil streams, or combinations of these. In some embodiments, a heavy oil may refer to a raw hydrocarbon, such as whole crude oil, which has not been previously processed through distillation, or may refer to a hydrocarbon oil, which has undergone some degree of processing prior to being introduced to the process 100 as the hydrocarbon feed 102. The hydrocarbon feed 12 may have a density of greater than or equal to 0.80 grams per milliliter. The hydrocarbon feed 12 may have an end boiling point (EBP) of greater than 565° C. The hydrocarbon feed 12 may have a concentration of nitrogen of less than or equal to 3000 parts per million by weight (ppmw).

In embodiments, the hydrocarbon feed 102 may be a crude oil, such as whole crude oil, or synthetic crude oil. The crude oil may have an American Petroleum Institute (API) gravity of from 22 degrees to 50 degrees, such as from 22 degrees to 40 degrees, from 25 degrees to 50 degrees, or from 25 degrees to 40 degrees. For example, the hydrocarbon feed 102 may include an extra light crude oil, a light crude oil, a heavy crude oil, or combinations of these. In embodiments, the hydrocarbon feed 102 can be a light crude oil, such as but not limited to an Arab light export crude oil. Example properties for an exemplary grade of Arab light crude oil are provided in Table 1.

TABLE 1

Example of Arab Light Export Feedstock

| Analysis | Units | Value | Test Method |
|---|---|---|---|
| American Petroleum Institute (API) gravity | degree | 33.13 | ASTM D287 |
| Density | grams per milliliter (g/mL) | 0.8595 | ASTM D287 |
| Carbon Content | weight percent (wt. %) | 85.29 | ASTM D5291 |
| Hydrogen Content | wt. % | 12.68 | ASTM D5292 |
| Sulfur Content | wt. % | 1.94 | ASTM D5453 |
| Nitrogen Content | parts per million by weight (ppmw) | 849 | ASTM D4629 |
| Asphaltenes | wt. % | 1.2 | ASTM D6560 |
| Micro Carbon Residue (MCR) | wt. % | 3.4 | ASTM D4530 |
| Vanadium (V) Content | ppmw | 15 | IP 501 |
| Nickel (Ni) Content | ppmw | 12 | IP 501 |
| Arsenic (As) Content | ppmw | 0.04 | IP 501 |
| Boiling Point Distribution | | | |
| Initial Boiling Point (IBP) | Degrees Celsius (° C.) | 33 | ASTM D7169 |
| 5% Boiling Point (BP) | ° C. | 92 | ASTM D7169 |

TABLE 1-continued

Example of Arab Light Export Feedstock

| Analysis | Units | Value | Test Method |
|---|---|---|---|
| 10% BP | ° C. | 133 | ASTM D7169 |
| 20% BP | ° C. | 192 | ASTM D7169 |
| 30% BP | ° C. | 251 | ASTM D7169 |
| 40% BP | ° C. | 310 | ASTM D7169 |
| 50% BP | ° C. | 369 | ASTM D7169 |
| 60% BP | ° C. | 432 | ASTM D7169 |
| 70% BP | ° C. | 503 | ASTM D7169 |
| 80% BP | ° C. | 592 | ASTM D7169 |
| 90% BP | ° C. | >720 | ASTM D7169 |
| 95% BP | ° C. | >720 | ASTM D7169 |
| End Boiling Point (EBP) | ° C. | >720 | ASTM D7169 |
| BP range $C_5$-180° C. | wt. % | 18.0 | ASTM D7169 |
| BP range 180° C.-350° C. | wt. % | 28.8 | ASTM D7169 |
| BP range 350° C.-540° C. | wt. % | 27.4 | ASTM D7169 |
| BP range >540° C. | wt. % | 25.8 | ASTM D7169 |

Weight percentages in Table 1 are based on the total weight of the crude oil.

In embodiments, the hydrocarbon feed 102 may be an Arab Extra Light (AXL) crude oil. An example boiling point distribution for an exemplary grade of an AXL crude oil is provided in Table 2.

TABLE 2

| Property | Units | Value | Test Method |
|---|---|---|---|
| 0.1% Boiling Point (BP) | ° C. | 21 | ASTM D7169 |
| 5% BP | ° C. | 65 | ASTM D7169 |
| 10% BP | ° C. | 96 | ASTM D7169 |
| 15% BP | ° C. | 117 | ASTM D7169 |
| 20% BP | ° C. | 141 | ASTM D7169 |
| 25% BP | ° C. | 159 | ASTM D7169 |
| 30% BP | ° C. | 175 | ASTM D7169 |
| 35% BP | ° C. | 196 | ASTM D7169 |
| 40% BP | ° C. | 216 | ASTM D7169 |
| 45% BP | ° C. | 239 | ASTM D7169 |
| 50% BP | ° C. | 263 | ASTM D7169 |
| 55% BP | ° C. | 285 | ASTM D7169 |
| 60% BP | ° C. | 308 | ASTM D7169 |
| 65% BP | ° C. | 331 | ASTM D7169 |
| 70% BP | ° C. | 357 | ASTM D7169 |
| 75% BP | ° C. | 384 | ASTM D7169 |
| 80% BP | ° C. | 415 | ASTM D7169 |
| 85% BP | ° C. | 447 | ASTM D7169 |
| 90% BP | ° C. | 486 | ASTM D7169 |
| 95% BP | ° C. | 537 | ASTM D7169 |
| End Boiling Point (EBP) | ° C. | 618 | ASTM D7169 |

When the hydrocarbon feed 102 comprises a crude oil, the crude oil may be a whole crude or may be a crude oil that has undergone at some processing, such as desalting, solids separation, scrubbing. For example, the hydrocarbon feed 102 may be a de-salted crude oil that has been subjected to a de-salting process. In embodiments, the hydrocarbon feed 102 may include a crude oil that has not undergone pretreatment, separation (such as distillation), or other operation or process that changes the hydrocarbon composition of the crude oil prior to introducing the crude oil to the system 100.

In embodiments, the hydrocarbon feed 102 can be a crude oil having a boiling point profile as described by the 5 wt. % boiling temperature, the 25 wt. % boiling temperature, the 50 wt. % boiling temperature, the 75 wt. % boiling temperature, and the 95 wt. % boiling temperature. These respective boiling temperatures correspond to the temperatures at which a given weight percentage of the hydrocarbon feed stream boils. In embodiments, the crude oil may have one or more of a 5 wt. % boiling temperature of less than or equal to 150° C.; a 25 wt. % boiling temperature of less than or equal to 225° C. or less than or equal to 200° C.; a 50 wt. % boiling temperature of less than or equal to 500° C., less than or equal 450° C., or less than or equal to 400° C.; a 75 wt. % boiling temperature of less than 600° C., less than or equal to 550° C.; a 95 wt. % boiling temperature of greater than or equal to 550° C. or greater than or equal to 600° C.; or combinations of these. In embodiments, the crude oil may have one or more of a 5 wt. % boiling temperature of from 0° C. to 100° C.; a 25 wt. % boiling temperature of from 150° C. to 250° C., a 50 wt. % boiling temperature of from 250° C. to 400° C., a 75 wt. % boiling temperature of from 350° C. to 600° C. and an end boiling point temperature of from 500° C. to 1000° C., such as from 500° C. to 800° C.

Referring again to FIG. 1, one embodiment of a steam catalytic cracking system 110 for steam catalytic cracking a hydrocarbon feed 102 is schematically depicted. The steam catalytic cracking system 110 may include at least one steam catalytic cracking reactor 130. The steam catalytic cracking reactor 130 may include one or more fixed bed reactors, fluid bed reactors, batch reactors, fluid catalytic cracking (FCC) reactors, moving bed catalytic cracking reactors, or combinations of these. In embodiments, the steam catalytic cracking reactor 130 may be a fixed bed reactor. In embodiments, the steam catalytic cracking reactor 130 may include a plurality of fixed bed reactors operated in a swing mode. Operation of the steam catalytic cracking reactor 130 will be described herein in the context of a fixed bed reactor. However, it is understood that other types of reactors, such as a fluid bed reactors, batch reactors, FCC reactors, or moving bed reactors, may also be used to contact the hydrocarbon feed 102 with the cracking catalyst to conduct the steam catalytic cracking of the process disclosed herein.

The steam catalytic cracking reactor 130 may operate to contact the hydrocarbon feed 102 with steam in the presence of the cracking catalyst of the present disclosure to produce a steam cracking effluent comprising light olefins, aromatic compounds, or combinations of these. As previously discussed, the steam catalytic cracking reactor 130 may be a fixed bed catalytic cracking reactor that may include the cracking catalyst 132 disposed within a steam catalytic cracking zone 134. The steam catalytic cracking reactor 130 may include a porous packing material 136, such as silica carbide packing, upstream of the steam catalytic cracking zone 134. The porous packing material 136 may ensure sufficient heat transfer to the hydrocarbon feed 102 and steam prior to conducting the steam catalytic cracking reaction in the steam catalytic cracking zone 134.

Referring again to FIG. 1, the hydrocarbon feed 102 may be introduced to the steam catalytic cracking reactor 130. In embodiments, the hydrocarbon feed 102 may be introduced directly to the steam catalytic cracking system 110, such as by passing the crude oil of the hydrocarbon feed 102 to the steam catalytic cracking reactor 130 without passing the hydrocarbon feed 102 to any separation system or unit operation that changes the hydrocarbon composition of the hydrocarbon feed 102. In embodiments, the hydrocarbon feed 102 may be processed upstream of the steam catalytic cracking system 110 to remove contaminants, such as but not limited to nitrogen compounds, sulfur-containing compounds, heavy metals, or other contaminants that may reduce the effectiveness of the cracking catalyst.

The processes disclosed herein can include introducing the hydrocarbon feed 102 to the steam catalytic cracking system 110, such as introducing the hydrocarbon feed 102 to the steam catalytic cracking reactor 130. Introducing the hydrocarbon feed 102 to the steam catalytic cracking reactor 130 may include heating the hydrocarbon feed 102 to a temperature of from 35° C. to 150° C. and then passing the hydrocarbon feed 102 to the steam catalytic cracking reactor 130. In embodiments, the distillation feed 110 may be heated from 40° C. to 150° C., from 45° C. to 150° C., from 50° C. to 150° C., from 35° C. to 145° C., from 40° C. to 145° C., from 45° C. to 145° C., from 35° C. to 140° C., from 40° C. to 140° C., or from 45° C. to 140° C.

In embodiments, passing the hydrocarbon feed 102 to the steam catalytic cracking reactor 130 may include passing the hydrocarbon feed 102 to a feed pump 104, where the feed pump 104 may increase the pressure of the hydrocarbon feed 102 and convey the hydrocarbon feed 102 to the steam catalytic cracking reactor 130. The flowrate of the feed pump 104 may be adjusted so that the hydrocarbon feed 102 is injected into the steam catalytic cracking reactor 130 at a gas hourly space velocity of greater than or equal to 0.1 per hour ($h^{-1}$) or greater than or equal to 0.25 $h^{-1}$. The hydrocarbon feed 102 may be injected into the steam catalytic cracking reactor 130 at a gas hourly space velocity of less than or equal to 50 $h^{-1}$, less than or equal to 25 $h^{-1}$, less than or equal to 20 $h^{-1}$, less than or equal to 14 $h^{-1}$, less than or equal to 9 $h^{-1}$, or less than or equal to 5 $h^{-1}$. The hydrocarbon feed 102 may be injected into the steam catalytic cracking reactor 130 at a gas hourly space velocity of from 0.1 $h^{-1}$ to 50 $h^{-1}$, from 0.1 $h^{-1}$ to 25 $h^{-1}$, from 0.1 $h^{-1}$ to 20 $h^{-1}$, from 0.1 $h^{-1}$ to 14 $h^{-1}$, from 0.1 $h^{-1}$ to 9 $h^{-1}$, from 0.1 $h^{-1}$ to 5 $h^{-1}$, from 0.1 $h^{-1}$ to 4 $h^{-1}$, from 0.25 $h^{-1}$ to 50 $h^{-1}$, from 0.25 $h^{-1}$ to 25 $h^{-1}$, from 0.25 $h^{-1}$ to 20 $h^{-1}$, from 0.25 $h^{-1}$ to 14 $h^{-1}$, from 0.25 $h^{-1}$ to 9 $h^{-1}$, from 0.25 $h^{-1}$ to 5 $h^{-1}$, from 0.25 $h^{-1}$ to 4 $h^{-1}$, from 1 $h^{-1}$ to 50 $h^{-1}$, from 1 $h^{-1}$ to 25 $h^{-1}$, from 1 $h^{-1}$ to 20 $h^{-1}$, from 1 $h^{-1}$ to 14 $h^{-1}$, from 1 $h^{-1}$ to 9 $h^{-1}$, or from 1 $h^{-1}$ to 5 $h^{-1}$ via feed inlet line 106. The hydrocarbon feed 102 may be further pre-heated in the feed inlet line 106 to a temperature of from 100° C. to 250° C. before injecting the hydrocarbon feed 102 into the steam catalytic cracking reactor 130.

Water 120 may be injected to the steam catalytic cracking reactor 130 through water feed line 122 via the water feed pump 124. The water feed line 122 may be pre-heated to heat the water 120 at to a temperature of from 50° C. to 175° C., from 50° C. to 150° C., from 60° C. to 175° C., or from 60° C. to 170° C. The water 120 may be converted to steam in water feed line 122 or upon contact with the hydrocarbon feed 102 in the steam catalytic cracking reactor 130. The flowrate of the water feed pump 124 may be adjusted to deliver the water 120 (liquid, steam, or both) to the steam catalytic cracking reactor 130 at a gas hourly space velocity of greater than or equal to 0.1 $h^{-1}$, greater than or equal to 0.5 $h^{-1}$, greater than or equal to 1 $h^{-1}$, greater than or equal to 5 $h^{-1}$, greater than or equal to 6 $h^{-1}$, greater than or equal to 10 $h^{-1}$, or even greater than or equal to 15 $h^{-1}$. The water 120 may be introduced to the steam catalytic cracking reactor 130 at a gas hourly space velocity of less than or equal to 100 $h^{-1}$, less than or equal to 75 $h^{-1}$, less than or equal to 50 $h^{-1}$, less than or equal to 30 $h^{-1}$, or less than or equal to 20 $h^{-1}$. The water 120 may be introduced to the steam catalytic cracking reactor 130 at a gas hourly space velocity of from 0.1 $h^{-1}$ to 100 $h^{-1}$, from 0.1 $h^{-1}$ to 75 $h^{-1}$, from 0.1 $h^{-1}$ to 50 $h^{-1}$, from 0.1 $h^{-1}$ to 30 $h^{-1}$, from 0.1 $h^{-1}$ to 20 $h^{-1}$, from 1 $h^{-1}$ to 100 $h^{-1}$, from 1 $h^{-1}$ to 75 $h^{-1}$, from 1 $h^{-1}$ to 50 $h^{-1}$, from 1 $h^{-1}$ to 30 $h^{-1}$, or from 1 $h^{-1}$ to 20 $h^{-1}$.

The steam from injection of the water 120 into the steam catalytic cracking reactor 130 may reduce the hydrocarbon partial pressure, which may have the dual effects of increasing yields of light olefins (e.g., ethylene, propylene and butylene) as well as reducing coke formation on the cracking catalyst. Not intending to be limited by any particular theory, it is believed that light olefins like propylene and butenes are mainly generated from catalytic cracking reactions following the carbonium ion mechanism, and as these are intermediate products, they can undergo secondary reactions such as hydrogen transfer and aromatization (leading to coke formation). The steam may increase the yield of light olefins by suppressing these secondary bi-molecular reactions, and may reduce the concentration of reactants and products, which favor selectivity towards light olefins. The steam may also suppresses secondary reactions that are responsible for coke formation on catalyst surface, which is good for catalysts to maintain high average activation. These factors may show that a large steam-to-oil weight ratio may be beneficial to the production of light olefins.

The mass flow rate of the water 120 to the steam catalytic cracking reactor 130 may be less than the mass flow rate of the hydrocarbon feed 102 to the steam catalytic cracking reactor 130. In embodiments, a mass flow ratio of the water 120 to the hydrocarbon feed 102 introduced to the steam catalytic cracking reactor 130 can be less than 1, such as less than or equal to 0.9, less than or equal to 0.8, less than or equal to 0.7, or less than or equal to 0.6. In embodiments, the mass flow ratio of the water 120 to the hydrocarbon feed 102 introduced to the steam catalytic cracking reactor 130 can be from 0.2 to less than 1, from 0.2 to 0.9, from 0.2 to 0.8, from 0.2 to 0.7, from 0.2 to 0.6, from 0.3 to less than 1, from 0.3 to 0.9, from 0.3 to 0.8, from 0.3 to 0.7, from 0.3 to 0.6, from 0.4 to less than 1, from 0.4 to 0.9, from 0.4 to 0.8, from 0.4 to 0.7, from 0.4 to 0.6, from 0.5 to less than 1, from 0.5 to 0.9, from 0.5 to 0.8, from 0.5 to 0.7, from 0.5 to 0.6. In embodiments, the mass flow ratio of the water 120 to the hydrocarbon feed 102 introduced to the steam catalytic cracking reactor 130 can be about 0.5. The water may be present as steam in the steam catalytic cracking reactor 130.

Referring again to FIG. 1, the steam catalytic cracking system 110 may be operable to contact the hydrocarbon feed 102 with steam (from water 120) in the presence of the cracking catalyst in the steam catalytic cracking reactor 130 under reaction conditions sufficient to cause at least a portion of the hydrocarbons from the hydrocarbon feed 102 to undergo one or more cracking reactions to produce a steam catalytic cracking effluent 140 comprising light olefins, light aromatic compounds, or both. In embodiments, the steam catalytic cracking effluent 140 may comprise light olefins, which may include but are not limited to ethylene, propylene, butenes, or combinations of these. In embodiments, the steam catalytic cracking effluent 140 may comprise light aromatic compounds, which refers to compounds containing an aromatic ring structure and having less than or equal to 10 carbon atoms. The light aromatic compounds in the steam catalytic cracking effluent 140 may include but are not limited to benzene, toluene, ethylbenzene, xylenes, or other light aromatic compounds.

The steam catalytic cracking reactor 130 may be operated at a temperature of greater than 450° C., greater than 475° C., greater than 500° C., greater than or equal to 525° C., greater than or equal to 550° C., greater than or equal to 575° C., or even greater than or equal to 600° C. The steam catalytic cracking reactor 130 may be operated at a temperature of less than or equal to 800° C., less than or equal to 750° C., less than or equal to 700° C., or even less than or equal to 675° C. The steam catalytic cracking reactor 130 may be operated at a temperature of from 525° C. to 800° C., from 525° C. to 750° C., from 525° C. to 700° C., from 525° C. to 675° C., from 550° C. to 750° C., from 550° C. to 700° C., from 550° C. to 675° C., from 575° C. to 750° C., from 575° C. to 700° C., from 575° C. to 675° C., from 600° C. to 750° C., from 600° C. to 700° C., or from 600° C. to 675° C. In embodiments, the steam catalytic cracking reactor 130 may be operated at a temperature of about 675° C. The process may operate at a pressure of from 1 bar (100 kPa) to 5 bar (500 kPa), such as from 1 bar (100 kPa) to 4 bar (400 kPa), from 1 bar (100 kPa) to 3 bar (300 kPa), from 1 bar (100 kPa) to 2 bar (200 kPa), or any subset thereof.

The methods of the present disclosure may include contacting the hydrocarbon feed 102 with the steam (water 120) in the presence of the cracking catalyst 132 in the steam catalytic cracking reactor 130 for a residence time sufficient to convert at least a portion of the hydrocarbon compounds in the hydrocarbon feed 102 to light olefins, light aromatic compounds, or both. In embodiments, the methods may include contacting the hydrocarbon feed 102 with the steam (water 120) in the presence of the cracking catalyst 132 in the steam catalytic cracking reactor 130 for a residence time of from 0.5 seconds to 1000 seconds, such as from 0.5 seconds to 500 seconds, from 0.5 seconds to 250 seconds, from 0.5 seconds to 100 seconds, from 1 second to 60 seconds, as from 1 second to 30 seconds, from 1 second to 10 seconds, or about 10 seconds.

When the steam catalytic cracking reactor 130 is a fixed bed reactor, the steam catalytic cracking reactor 130 may be operated in a semi-continuous manner. For example, during a conversion cycle, the steam catalytic cracking reactor 130 may be operated with the hydrocarbon feed 102 and water 120 flowing to the steam catalytic cracking reactor 130 for a period of time. After the period of the time, the cracking catalyst may be regenerated. Each conversion cycle of the steam catalytic cracking reactor 130 may be from 2 to 24 hours, from 2 to 20 hours, from 2 to 16 hours, from 2 to 12 hours, from 2 to 10 hours, from 2 to 8 hours, from 4 to 24 hours, from 4 to 20 hours, from 4 to 16 hours, from 4 to 12 hours, from 4 to 10 hours, from or 4 to 8 hours before switching off the feed pump 104 and the water feed pump 124 to cease the flow of hydrocarbon and steam to the steam catalytic cracking reactor 130.

At the end of the conversion cycle, the flow of hydrocarbon feed 102 and water 120 may be stopped and the cracking catalyst 132 may be regenerated during a regeneration cycle. In embodiments, the steam catalytic cracking system 110 may include a plurality of fixed bed steam catalytic cracking reactors 130, which may be operated in parallel or in series. In embodiments, the steam catalytic cracking system 110 may include 1, 2, 3, 4, 5, 6, or more than 6 steam catalytic cracking reactors 130, which may be operated in series or in parallel. With a plurality of steam catalytic cracking reactors 130 operating in parallel, one or more of the steam catalytic cracking reactors 130 can continue in a conversion cycle while one or more of the other steam catalytic cracking reactors 130 are taken off-line for regeneration of the nanozeolite cracking catalyst 132, thus maintaining continuous operation of the steam catalytic cracking system 110.

Referring again to FIG. 1, during a regeneration cycle, the steam catalytic cracking reactor 130 may be operated to regenerate the cracking catalyst 132. The cracking catalyst 132 may be regenerated to remove coke deposits accumulated during the conversion cycle. To regenerate the cracking catalyst 132, hydrocarbon gas and liquid products produced by the steam catalytic cracking process may be evacuated from the steam catalytic cracking reactor 130. Nitrogen gas may be introduced to the steam catalytic cracking reactor 130 through gas inlet line 112 to evacuate the hydrocarbon gas and liquid products from the fixed bed steam catalytic cracking reactor 130. Nitrogen may be introduced to the steam catalytic cracking reactor 130 at gas hourly space velocity of from 10 per hour ($h^{-1}$) to 100 $h^{-1}$.

Following evacuation of the hydrocarbon gases and liquids, air may be introduced to the steam catalytic cracking reactor 130 through the gas inlet line 112 at a gas hourly space velocity of from 10 $h^{-1}$ to 100 $h^{-1}$. The air may be passed out of the steam catalytic cracking reactor 130 through air outlet line 142. While passing air through the cracking catalyst 132 in the steam catalytic cracking reactor 130, the temperature of the steam catalytic cracking reactor 130 may be increased from the reaction temperature to a regeneration temperature of from 650° C. to 750° C. for a period of from 3 hours to 5 hours. The gas produced by air regeneration of the cracking catalyst 132 may be passed out of the steam catalytic cracking reactor 130 and may be analyzed by an in-line gas analyzer to detect the presence or concentration of carbon dioxide produced through de-coking of the cracking catalyst 132. Once the carbon dioxide concentration in the gases passing out of the steam catalytic cracking reactor 130 are reduced to less than 0.05% to 0.1% by weight, as determined by the in-line gas analyzer, the temperature of the steam catalytic cracking reactor 130 may be decreased from the regeneration temperature back to the reaction temperature. The air flow through gas inlet line 112 may be stopped. Nitrogen gas may be passed through the cracking catalyst 132 for 15 to 30 minutes to remove air from the steam catalytic cracking reactor 130. Following treatment with nitrogen, the flows of the hydrocarbon feed 102 and water 120 may be resumed to begin another conversion cycle of steam catalytic cracking reactor 130. Although described herein in the context of a fixed bed reactor system, it is understood that the steam catalytic cracking reactor 130 can be a different type of reactor, such as a fluidized bed reactor, a moving bed reactor, a batch reactor, an FCC reactor, or combinations of these.

Referring again to FIG. 1, the steam catalytic cracking effluent 140 may pass out of the steam catalytic cracking reactor 130. The steam catalytic cracking effluent 140 may include one or more products and intermediates, such as but not limited to light hydrocarbon gases, light olefins, aromatic compounds, pyrolysis oil, or combinations of these. The light olefins in the steam catalytic cracking effluent 140 may include ethylene, propylene, butenes, or combinations of these.

As previously discussed, the cracking catalyst comprises a framework-substituted pentasil zeolite. In embodiments, the cracking catalyst comprises, consists of, or consists essentially of the framework-substituted pentasil zeolite. In embodiments, the cracking catalyst may include the framework-substituted pentasil zeolite catalyst with Ce and monomeric Fe substituted into the zeolite framework in place of framework aluminum atoms. The cracking catalyst does not have any other catalytic species impregnated into the framework-substituted pentasil zeolite, deposited on the surface of the framework-substituted pentasil zeolite, or otherwise incorporated into the framework-substituted pentasil zeolite.

Figure 2:
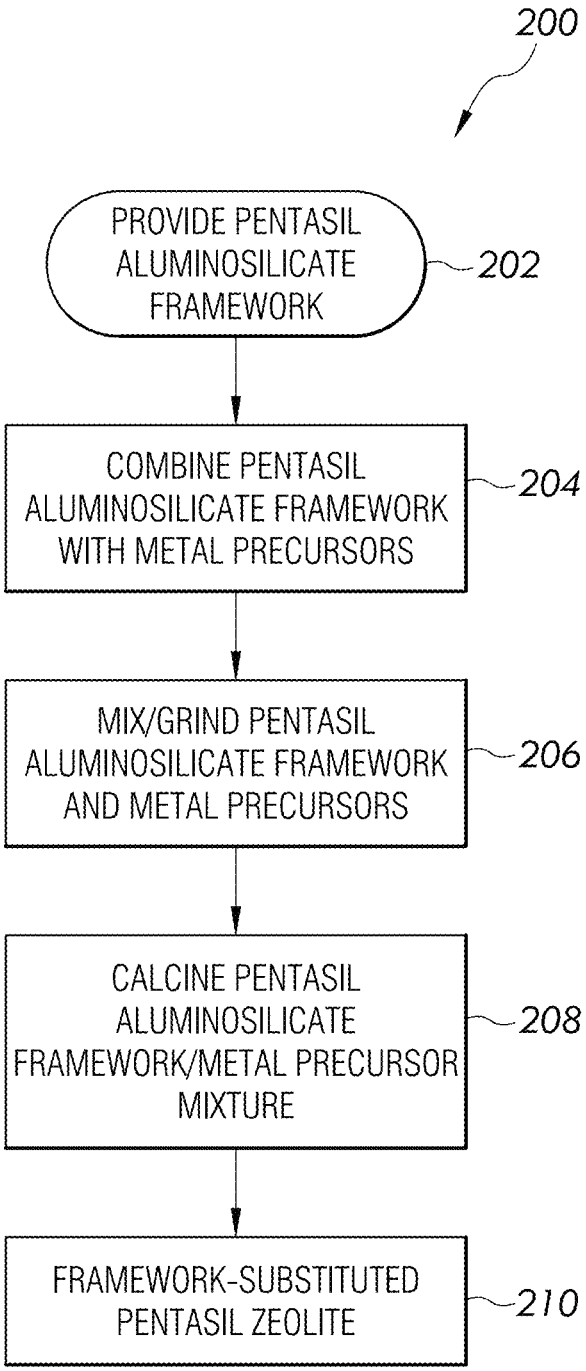
FIG. 2 depicts a flowchart of a method for producing a cracking catalyst comprising a framework-substituted pentasil zeolite, according to one or more embodiments shown and described in the present disclosure.
Figure 4:
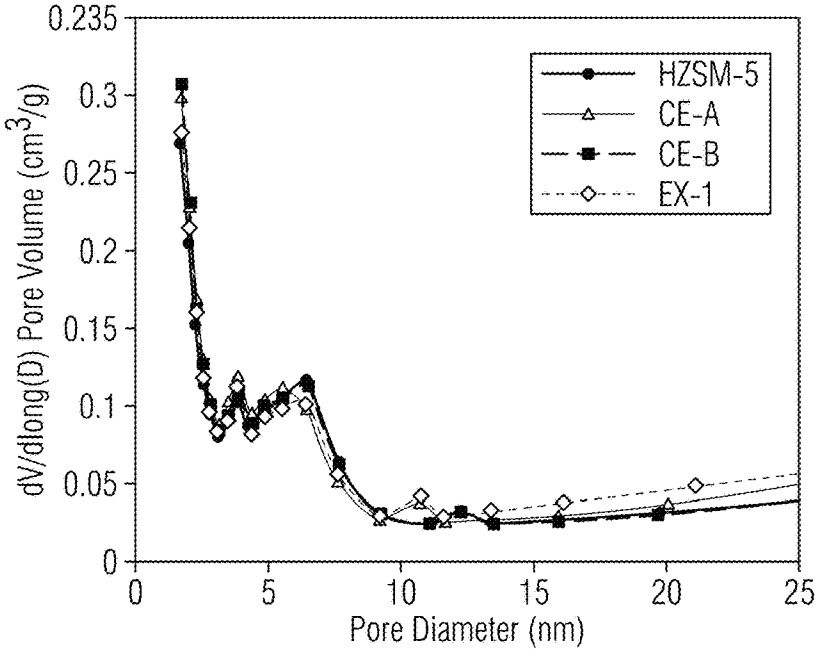
FIG. 4 graphically depicts a pore size distribution for a framework-substituted pentasil zeolite, according to one or more embodiments shown and described in the present disclosure.

Referring now to FIG. 2, a process 200 for preparing the framework-substituted pentasil zeolite may include providing a starting pentasil zeolite having an aluminosilicate framework, such as a ZSM-5 zeolite, in step 202; combining the starting pentasil zeolite having the aluminosilicate framework with metal precursors to form a first mixture, in step 204; mixing and/or grinding the first mixture in step 206; calcining the first mixture, step 208; thereby forming the framework-substituted pentasil zeolite, shown in step 210.

The starting pentasil zeolite may be a shape selective zeolite that can be active to catalytically-crack hydrocarbons to produce smaller hydrocarbon molecules, such as the light olefins, light aromatic compounds, or both. Suitable pentasil zeolites may include ZSM-5 zeolites. As used in the present disclosure, "ZSM-5" refers to zeolites having an MFI framework type according to the IUPAC zeolite nomenclature and consisting of silica and alumina. ZSM-5 refers to "Zeolite Socony Mobil-5" and is a pentasil family zeolite that can be represented by the chemical formula $Na_nAl_nSi_{96-n}O_{192}\cdot 16H_2O$, where $0<n<27$. In embodiments, the aluminosilicate framework of the starting pentasil zeolite may have a microporous pore structure with an average pore size of less than or equal to 2 nm. The starting pentasil zeolite may have a molar ratio of silica to alumina of greater than or equal to 10 or greater than or equal to 20. The starting pentasil zeolite may have a molar ratio of silica to alumina of less than or equal to 300, such as less than or equal to 200, less than or equal to 100, or even less than or equal to 40. In embodiments, the starting pentasil zeolite may have a molar ratio of silica to alumina of from 10 to 300, from 10 to 200, from 10 to 100, from 10 to 50, from 20 to 300, from 20 to 200, from 20 to 100, from 20 to 50, or from 50 to 300. The starting pentasil zeolite may be in the form of a plurality of particles, such as a plurality of spherical particles.

The starting pentasil zeolite having the aluminosilicate framework is then combined with metal precursors, to form a first mixture. The metal precursors may comprise cerium (Ce) precursors and iron (Fe) precursors. The Ce precursors may include any compound or family of compounds which containing Ce and produces Ce ions when exposed to high temperatures during calcination (such as greater than 500° C.). Suitable Ce precursors may include, but are not limited to, Ce-acetylacetonates (such as $Ce(ACAC)_2$), Ce-nitrates, Ce-chlorides, or combinations of these. The Fe precursors may include any compound or family of compounds which containing Fe and produces Fe ions when exposed to high temperatures during calcination (such as greater than 500° C. Suitable Fe precursors may include, but are not limited to, Fe-acetylacetonates (such as $Fe(ACAC)_2$), Fe-nitrates, Fe-chlorides, or combinations of these. The first mixture may comprise at least 80 wt. %, at least 90 wt. %, at least 95 wt. %, at least 99 wt. %, at least 99 wt. %, or even 100 wt. % of the starting pentasil zeolite, the cerium precursor, and the iron precursor, based on the total weight of the first mixture.

The first mixture may be mixed to produce a relatively homogeneous solid mixture. In embodiments, the first mixture may be mixed in a grinder or mixed using a mortar and pestle. The first mixture may be mixed until the first mixture is visibly uniform. The first mixture may be a dry solid mixture. In embodiments, the first mixture may comprise less than 5 wt. %, less than 1 wt. %, or even less than 0.1 wt. % of solvents (such as water or organic solvents).

The first mixture may be calcined to form the framework-substituted pentasil zeolite. The first mixture may be calcined in an oxidizing atmosphere, such as air. The first mixture may be calcined at a temperature of at least 500° C., such as at least 525° C., at least 550° C., from 500° C., to 700° C., from 500° C. to 600° C., from 500° C. to 575° C., from 525° C. to 700° C., from 525° C. to 600° C., from 525° C. to 575° C., or any subset thereof. Without being limited by theory, it is believed that calcining the first mixture may cause the Ce and Fe precursor atoms to be substituted for the framework aluminum atoms of the starting pentasil zeolite.

The framework-substituted pentasil zeolite may comprise cerium atoms substituted for a portion of the framework aluminum atoms originally making up the aluminosilicate framework of the starting pentasil zeolite. The cerium atoms may be monomeric or oligomeric. Monomeric cerium atoms may be in the form of cerium cations, such as $Ce^{3+}$, $Ce^{4+}$, or both Oligomeric cerium atoms may be in the form of cerium oxides, such as $CeO_2$, $Ce_2O_3$, or both. In embodiments, the cerium atoms may be primarily monomeric. In embodiments, at least 40%, at least 60%, at least 80%, at least 90%, at least 95%, or even at least 99% of the cerium atoms in the framework-substituted pentasil zeolite may be monomeric cerium atoms. The ratio of monomeric to oligomeric cerium atoms can be determined by, for example, UV-Vis spectroscopy. The framework-substituted pentasil zeolite may comprise greater than 0 wt. % and less than or equal to 1.0 wt. % of the cerium atoms, on the basis of the total weight of the framework-substituted pentasil zeolite. In embodiments, the framework-substituted pentasil zeolite may comprise greater than 0 wt. % and less than or equal to 0.8 wt. %, greater than 0 wt. % and less than or equal to 0.6 wt. %, greater than 0 wt. % and less than or equal to 0.4 wt. %, greater than 0 wt. % and less than or equal to 0.3 wt. %, from 0.1 to 1.0 wt. %, from 0.2 wt. % to 1.0 wt. %, from 0.2 wt. % to 0.8 wt. %, from 0.2 wt. % to 0.6 wt. %, from 0.2 wt. % to 0.4 wt. %, from 0.2 wt. % to 0.3 wt. %, from 0.1 to 0.3 wt. %, about 0.2 wt. % or any subset thereof, of the cerium atoms, on the basis of the total weight of the framework-substituted pentasil zeolite.

The framework-substituted pentasil zeolite may comprise iron atoms substituted for a portion of the framework aluminum atoms originally making up the aluminosilicate framework of the starting pentasil zeolite. The iron atoms may be monomeric or oligomeric. Monomeric iron atoms may be in the form of iron cations, such as $Fe^{2+}$, $Fe^{3+}$, $Fe^{4+}$, or combinations thereof. Oligomeric iron atoms may be in the form of iron oxides, such as $FeO_2$, $Fe_2O_3$, or combinations thereof. In embodiments, the iron atoms may be primarily monomeric. In embodiments, at least 40%, at least 60%, at least 80%, at least 90%, at least 95%, or even at least 99% of the ion atoms in the framework-substituted pentasil zeolite may be monomeric. The ratio of monomeric to oligomeric iron atoms can be determined by, for example, UV-Vis spectroscopy. The framework-substituted pentasil zeolite may comprise at least 0.2 wt. % of the iron atoms, on the basis of the total weight of the framework-substituted pentasil zeolite. In embodiments, the framework-substituted pentasil zeolite may comprise at least 0.4 wt. % iron atoms, such as from 0.2 wt. % to 1.0 wt. %, from 0.2 wt. % to 0.8 wt. %, from 0.2 wt. % to 0.6 wt. %, from 0.4 wt. % to 1.0 wt. %, from 0.4 wt. % to 0.8 wt. %, from 0.4 wt. % to 0.6 wt. %, about 0.5 wt. % or any subset thereof, of the iron atoms, on the basis of the total weight of the framework-substituted pentasil zeolite.

The weight ratio of cerium to iron may be from 1:5 to 5:5. In embodiments, the ratio of cerium to iron may be from 1:5 to 4:5, from 1:5 to 3:5, from 1:5 to 2:5, from 2:5 to 5:5, from 2:5 to 4:5, from 2:5 to 3:5, about 2:5, or any subset thereof.

The framework-substituted pentasil zeolite, following substitution, may have a molar ratio of silica to alumina of greater than or equal to 10 or greater than or equal to 20. The framework-substituted pentasil zeolite can have a molar ratio of silica to alumina of less than or equal to 300, such as less than or equal to 200, less than or equal to 100, or even less than or equal to 40. In embodiments, the framework-substituted pentasil zeolite can have a molar ratio of silica to alumina of from 10 to 300, such as from 10 to 200, from 10 to 100, from 10 to 50, from 20 to 300, from 20 to 200, from 20 to 100, from 20 to 50, or from 50 to 300.

The framework-substituted pentasil zeolite may be in the form of a plurality of particles. In embodiments, the framework-substituted pentasil zeolite may have an average crystal size of greater than or equal to 50 nm, greater than or equal to 100 nm, or even greater than or equal to 200 nm. The framework-substituted pentasil zeolite may have an average crystal size of less than or equal to 600 nm or less than or equal to 500 nm. In embodiments, the framework-substituted pentasil zeolite may have an average crystal size of from 50 nm to 600 nm, from 50 nm to 500 nm, from 100 nm to 600 nm, from 100 nm to 500 nm, from 200 nm to 600 nm, or from 200 nm to 500 nm. The average crystal size is determined by scanning electron microscopy (SEM) according to known methods.

In embodiments, the framework-substituted pentasil zeolite may have a specific surface area of from 200 $m^2/g$ to 600 $m^2/g$, such as from 200 $m^2/g$ to 500 $m^2/g$, from 200 $m^2/g$ to 400, from 300 $m^2/g$ to 600 $m^2/g$, from 300 $m^2/g$ to 500 $m^2/g$, from 300 $m^2/g$ to 400 $m^2/g$, from 325 $m^2/g$ to 375 $m^2/g$, or any subset thereof. The specific surface area is determined according to the Brunauer-Emmett-Teller (BET) method. The specific surface area may be referred to throughout the present disclosure as the BET surface area.

The framework-substituted pentasil zeolite may have a total pore volume of from 0.1 centimeter cubed per gram ($cm^3/g$) to 0.60 $cm^3/g$, such as from 0.1 $cm^3/g$ to 0.5 $cm^3/g$, from 0.1 $cm^3/g$ to 0.4 $cm^3/g$, from 0.1 $cm^3/g$ to 0.3 $cm^3/g$, from 0.1 $cm^3/g$ to 0.2 $cm^3/g$, from 0.15 $cm^3/g$ to 0.6 $cm^3/g$, from 0.15 $cm^3/g$ to 0.4 $cm^3/g$, from 0.15 $cm^3/g$ to 0.2 $cm^3/g$, from 0.16 $cm^3/g$ to 0.19 $cm^3/g$, or about 0.179 $cm^3/g$. The total pore volume is determined from measured gas adsorption isotherms through Non-Local Density Functional Theory (NLDFT) modeling and analysis. The BET method is also used to determine the total pore volume.

In embodiments, the framework-substituted pentasil zeolite may not include any heteroatoms substituted into the framework of the zeolite, other than the cerium and iron atoms. Heteroatoms substituted into the zeolite framework refer to elements such metals or metalloids substituted into the zeolite framework in place of silicon, aluminum, or both. In embodiments, the cracking catalyst can include the framework-substituted pentasil zeolite without any other catalytic species impregnated onto or otherwise deposited onto the surfaces of the framework-substituted pentasil zeolite or into the pores of the framework-substituted pentasil zeolite, other than the cerium and iron atoms that are substituted into the zeolite framework. In embodiments, the framework-substituted pentasil zeolite may be substantially free of impregnated metals, metalloids, or oxides thereof, such as having less than or equal to 0.01 wt. % impregnated metals, metalloids, or oxides thereof based on the total weight of the framework-substituted pentasil zeolite, other than the cerium and iron atoms that are substituted into the zeolite framework. The presence of impregnated metals, metalloids, or oxides of these can change the catalytic properties of the framework-substituted pentasil zeolite for converting crude oil to light olefins, light aromatic compounds or both through steam catalytic cracking. The cracking catalyst may comprise individual particles of the framework-substituted pentasil zeolite having an average particle size of from 150 micrometers (μm) to 200 μm. In embodiments, the cracking catalyst may consist of or consist essentially of the framework-substituted pentasil zeolite. In embodiments, the cracking catalyst does not include any binders, matrix materials, or other catalytic species supported on the framework-substituted pentasil zeolite. In embodiments, the cracking catalyst may comprise at least 10 wt. %, at least 20 wt. %, from 10 wt. % to 100 wt. %, from 10 wt. % to 15 wt. %, from 15 wt. % to 20 wt. %, from 20 wt. % to 30 wt. %, from 30 wt. % to 40 wt. %, from 40 wt. % to 50 wt. %, from 50 wt. % to 75 wt. %, from 75 wt. % to 100 wt. %, or any combination of these ranges of the framework-substituted pentasil zeolite. In embodiments, the balance of the cracking catalyst may comprise Equilibrium Catalyst (ECAT).

Referring again to FIG. 1, the steam catalytic cracking system 110 may further include a cracking effluent separation system 150 disposed downstream of the steam catalytic cracking reactors 130. When the steam catalytic cracking system 110 includes a plurality of steam catalytic cracking reactors 130, the steam catalytic cracking effluents 140 from each of the steam catalytic cracking reactors 130 may be passed to a single shared cracking effluent separation system 150. In embodiments, each steam catalytic cracking reactor 130 may have its own dedicated cracking effluent separation system 130. The steam catalytic cracking effluent 140 may be passed from the steam catalytic cracking reactor 130 directly to the cracking effluent separation system 150. The cracking effluent separation system 150 may separate the steam catalytic cracking effluent 140 into one or more than one cracking product effluents, which may be liquid or gaseous product effluents.

Referring again to FIG. 1, the cracking effluent separation system 150 may include one or a plurality of separation units. Separation units may include but are not limited to distillation columns, fractionators, flash drums, knock-out drums, knock-out pots, centrifuges, decanters, filtration devices, traps, scrubbers, expansion devices, membranes, solvent extraction devices, adsorption devices, chemical separators, crystallizers, chromatographs, precipitators, evaporators, driers, high-pressure separators, low-pressure separators, or combinations or these. The separation units may include one or more gas-liquid separators, one or more liquid-liquid separators, or a combination of these.

In embodiments, the cracking effluent separation system 150 may include a gas-liquid separation unit 160 and a centrifuge unit 170 downstream of the gas-liquid separation unit 160. The gas-liquid separation unit 160 may operate to separate the steam catalytic cracking effluent 140 into a liquid effluent 162 and a gaseous effluent 164. The gas-liquid separation unit 160 may operate to reduce the temperature of the steam catalytic cracking effluent 140 to condense constituents of the steam catalytic cracking effluent 140 having greater than or equal to 5 carbon atoms. The gas-liquid separation unit 160 may operate at a temperature of from 10° C. to 15° C. to ensure that normal pentane and constituents with boiling point temperatures greater than normal pentane are condensed into the liquid effluent 162. The liquid effluent 162 may include distillation fractions such as naphtha, kerosene, gas oil, vacuum gas oil; unconverted feedstock; residue; water; or combinations of these. The liquid effluent 162 may include the light aromatic compounds produced in the steam catalytic cracking reactor 130, which light aromatic compounds may include but are not limited to benzene, toluene, mixed xylenes, ethylbenzene, and other light aromatic compounds. The liquid effluent 162 may include at least 95%, at least 98%, at least 99%, or even at least 99.5% of the hydrocarbon constituents of the steam catalytic cracking effluent 140 having greater than or equal to 5 carbon atoms. The liquid effluent 162 may include at least 95%, at least 98%, at least 99%, or even at least 99.5% of the water from of the steam catalytic cracking effluent 140.

The gaseous effluent 164 may include olefins, such as ethylene, propylene, butenes, or combinations of these; light hydrocarbon gases, such as methane, ethane, propane, n-butane, i-butane, or combinations of these; other gases, such as but not limited to hydrogen; or combinations of these. The gaseous effluent 164 may include the $C_2$-$C_4$ olefin products, such as but not limited to, ethylene, propylene, butenes (1-butene, cis-2-butene, trans-2-butene, isobutene, or combinations of these), or combinations of these, produced in the steam catalytic cracking reactor 130. The gaseous effluent 164 may include at least 90%, at least 95%, at least 98%, at least 99%, or at least 99.5% of the $C_2$-$C_4$ olefins from the steam catalytic cracking effluent 140. The gaseous effluent 164 may be passed to a downstream gas separation system (not shown) for further separation of the gaseous effluent 164 into various product streams, such as but not limited to one or more olefin product streams.

In embodiments, the liquid effluent 162, which includes the water and hydrocarbon having greater than 5 carbon atoms, may be passed to the in-line centrifuge unit 170. The in-line centrifuge unit 170 may operate to separate the liquid effluent 162 into a liquid hydrocarbon effluent 172 and an aqueous effluent 174. The in-line centrifuge unit 170 may be operated at a rotational speed of from 2500 rpm to 5000 rpm, from 2500 rpm to 4500 rpm, from 2500 rpm to 4000 rpm, from 3000 rpm to 5000 rpm, from 3000 rpm to 4500 rpm, or from 3000 rpm to 4000 rpm to separate the hydrocarbon phase from the aqueous phase.

The liquid hydrocarbon effluent 172 may include hydrocarbons from the steam catalytic cracking effluent 140 having greater than or equal to 5 carbon atoms. The liquid hydrocarbon effluent 172 may include the light aromatic compounds produced in the steam catalytic cracking reactor 130, which light aromatic compounds may include but are not limited to benzene, toluene, mixed xylenes, ethylbenzene, and other light aromatic compounds. The liquid hydrocarbon effluent 172 may further include naphtha, kerosene, diesel, vacuum gas oil (VGO), or combinations of these. The liquid hydrocarbon effluent 172 may include at 90%, at least 95%, at least 98%, at least 99%, or even at least 99.5% of the hydrocarbon constituents from the liquid effluent 162. The liquid hydrocarbon effluent 172 may be passed to a downstream treatment processes for further conversion or separation. At least a portion of the liquid hydrocarbon effluent 172 may be passed back to the steam catalytic cracking reactor 130 for further conversion to olefins. The aqueous effluent 174 may include water and water soluble constituents from the liquid effluent 162. The aqueous effluent 174 may include some dissolved hydrocarbons soluble in the aqueous phase of the liquid effluent 162. The aqueous effluent 174 may include at least 95%, at least 98%, at least 99%, or even at least 99.5% of the water from the liquid effluent 162. The aqueous effluent 174 may be passed to one or more downstream processes for further treatment. In embodiments, at least a portion of the aqueous effluent 174 may be passed back to the steam catalytic cracking reactor 130 as at least a portion of the water 120 introduced to the steam catalytic cracking reactor 130.

In embodiments, the framework-substituted pentasil zeolite produced by previously described processes may be used as a catalyst in a fluidized catalytic cracking (FCC) reactor. The FCC reactor may be a fluidized bed reactor. In the FCC reactor, the cracking catalyst comprising, consisting of, or consisting essentially of the framework-substituted pentasil zeolite may be contacted with the hydrocarbon feed, such as crude oil, in the presence of steam to produce light olefins, light aromatic compounds, or combinations of these. Suitable FCC processes for catalytically cracking crude oil in the presence of steam are disclosed in U.S. patent application Ser. No. 17/009,008, U.S. patent application Ser. No. 17/009,012, U.S. patent application Ser. No. 17/009,020, U.S. patent application Ser. No. 17/009,022, U.S. patent application Ser. No. 17/009,039, U.S. patent application Ser. No. 17/009,048, and U.S. patent application Ser. No. 17/009,073, all of which are incorporated by reference in their entireties in the present disclosure. The hydrocarbon feed can be any of the hydrocarbon feeds previously discussed in the present disclosure. The FCC reactor may be an upflow or a downflow FCC reactor. The FCC reactor system can include one or a plurality of FCC reactors, with one or a plurality of catalyst regenerators.

In embodiments, the FCC reactor may be operated at a reaction temperature of at least 450° C., such as at least about 500° C., from 500° C. to 800° C., from 550° C. to 800° C., from 600° C. to 800° C., from 650° C. to 800° C., from 450° C. to 750° C., from 500° C. to 750° C., from 550° C. to 750° C., from 600° C. to 750° C., from 650° C. to 750° C., from 500° C. to 700° C., from 550° C. to 700° C., from 600° C. to 700° C., or from 650° C. to 700° C. Steam may be injected to the FCC reactor. The hydrocarbon feed may be catalytically cracked in the presence of the steam with the framework-substituted pentasil zeolite. The steam to the hydrocarbon mass ratio in the FCC reactor may be from 0.2 to 0.8, from 0.3 to 0.8, from 0.4 to 0.8, from 0.5 to 0.8, from 0.2 to 0.7, from 0.3 to 0.7, from 0.4 to 0.7, from 0.5 to 0.7, from 0.2 to 0.6, from 0.3 to 0.6, from 0.4 to 0.6, from 0.5 to 0.6, or about 0.5. Steam may refer to all water in the FCC reactor. In embodiments, the residence time of the hydrocarbon feed and the steam in contact with the cracking catalyst in the FCC reactor may be from 0.5 seconds to 1000 seconds, from 0.5 seconds to 500 seconds, from 0.5 seconds to 250 seconds, from 0.5 seconds to 100 seconds, from 0.5 seconds to 60 seconds, from 0.5 seconds to 20 seconds, from 1 second to 20 seconds, from 2 seconds to 20 seconds, from 5 seconds to 20 seconds, from 8 seconds to 20 seconds, from 1 second to 18 seconds, from 2 seconds to 18 seconds, from 5 seconds to 18 seconds, from 8 seconds to 18 seconds, from 1 second to 16 seconds, from 2 seconds to 16 seconds, from 5 seconds to 16 seconds, from 8 seconds to 16 seconds, from 1 second to 14 seconds, from 2 seconds to 14 seconds, from 5 seconds to 14 seconds, from 8 seconds to 14 seconds, from 1 second to 12 seconds, from 2 seconds to 12 seconds, from 5 seconds to 12 seconds, or from 8 seconds to 12 seconds. In embodiments, the cracking catalyst to hydrocarbon (catalyst to oil) weight ratio in the FCC reactor may be from 3 to 40, such as from 3 to 30, from 3 to 20, from 5 to 40, from 5 to 30, from 5 to 20, from 5 to 10, from 7 to 40, from 7 to 30, 7 to 20, from 7 to 10, from 10 to 40, from 10 to 30, from 10 to 20, or from 20 to 40. The cracking effluent from the FCC reactor can be separated into various product streams, intermediate streams, and an aqueous stream in a separation system downstream of the FCC reactor.

EXAMPLES

The various aspects of the present disclosure will be further clarified by the following examples. The examples are illustrative in nature and should not be understood to limit the subject matter of the present disclosure.

Example CE-A: Preparation of Comparative Cracking Catalyst A

In Example CE-A, a comparative cracking catalyst was produced according to an incipient wetness impregnation method. Specifically, 5 g of a HZSM-5 powder (CBV3024E with a silica/alumina ratio 30, purchased from Zeolyst International) was charged into a 250 mL round bottom flask equipped with a magnetic stirrer. The flask was then submerged in a 25° C. water bath and the powder was then agitated constantly. Separately, a 10 mL precursor solution was prepared by dissolving 31 mg cerium (III) nitrate hexahydrate and 180.9 mg iron (III) nitrate nonahydrate in deionized water. The precursor solution was then added slowly to the round bottom flask. After complete solution addition, the slurry was stirred vigorously for three hours. The obtained material was then dried slowly at 50° C., on a hot plate followed by overnight drying at 100° C. The dry powder was then ground and subsequently calcined in a furnace at 550° C. with a heating ramp of 5° C./min for 5 h in air.

Example CE-B: Preparation of Comparative Cracking Catalyst B

In Example CE-B, a comparative framework-substituted pentasil zeolite was produced according to a liquid ion exchange method. Specifically, 100 mL of a precursor solution was prepared by dissolving 309.9 mg cerium (III) nitrate hexahydrate and 1808.6 mg iron (III) nitrate nonahydrate in deionized water and heating the temperature of the solution to 80° C. Afterwards, 5 g HZSM-5 powder was added into the solution slowly and the solution was stirred for 2 hours. The sample was filtered, washed with deionized water and then dried at 110° C. in an oven overnight. The dry powder was ground and subsequently calcined in a furnace at 550° C. with a heating ramp of 5° C./min for 5 h in air.

Example EX-1: Preparation of Example Cracking Catalyst EX-1

In Example EX-1, the framework-substituted pentasil zeolite of the present disclosure was produced according to a solid-state ion exchange method (SSIE). Specifically, 5 g HZSM-5 powder was mixed and intensively ground with 31 mg cerium (III) nitrate hexahydrate and 180.9 mg iron (III) nitrate nonahydrate in an agate mortar for 1 h under ambient condition. The obtained mixture was calcined in a furnace at 550° C. with a heating ramp of 5° C./min for 5 hours in air to produce the cracking catalyst of Example EX-1. The compositions of the EX-1 catalyst is provided in Table 3.

Example EX-2: Preparation of Cracking Catalyst EX-2

In Example EX-2, a framework-substituted pentasil zeolite was produced according to the same methods described for producing the EX-1 catalyst. For Example, EX-2, the Fe (iron (III) nitrate nonahydrate) was added first. The catalyst was calcined as described for EX-1. After the first calcination, the Ce (cerium (III) nitrate hexahydrate) was added. The catalyst was again calcined as described for EX-1. The composition of the EX-2 catalyst is provided in Table 3.

Example EX-3: Preparation of Cracking Catalyst EX-3

In Example EX-3, a framework-substituted pentasil zeolite was produced according to the same methods described for producing the EX-1 catalyst. For Example, EX-3, the Ce (cerium (III) nitrate hexahydrate) was added first. The catalyst was calcined as described for EX-1. After the first calcination, the Fe (iron (III) nitrate nonahydrate) was added. The catalyst was again calcined as described for EX-1. The composition of the EX-3 catalyst is provided in Table 3.

Example EX-4-EX-6: Preparation of Cracking Catalysts 4 to 6

In each of Examples EX-4 to EX-6, a framework-substituted pentasil zeolite was produced according to the same methods as EX-1. However, the Ce and Fe concentrations were adjusted and the compositions for the EX-4, EX-5, and EX-6 catalysts are provided in Table 3.

Example CE-C: Preparation of Comparative Cracking Catalyst C

In Example CE-C, a comparative framework-substituted pentasil zeolite was produced according to the same methods as EX-1. However, no Fe was used.

Example CE-D: Preparation of Comparative Cracking Catalyst D

In Example CE-D, a comparative framework-substituted pentasil zeolite was produced according to the same methods as EX-1. However, no Ce was used.

TABLE 3

| Catalyst | Ce (wt %) | Fe (wt %) |
|---|---|---|
| CE-A | 0.2 | 0.5 |
| CE-B | 0.2 | 0.5 |
| CE-C | 0.2 | — |
| CE-D | — | 0.5 |
| EX-2 | 0.2 | 0.5 |
| EX-3 | 0.2 | 0.5 |
| EX-1 | 0.2 | 0.5 |
| EX-4 | 0.5 | 0.2 |
| EX-5 | 0.5 | 0.5 |
| EX-6 | 1.0 | 0.5 |

Catalyst Formation Efficiency

As is shown in Table 4, the efficiency of the impregnation process was calculated. As can be seen in Table 4, the present process (used to produce EX-1) was more efficient at utilizing the cerium and iron precursors than the incipient wetness method used to produce CE-A.

TABLE 4

| | EX-1 | CE-A | CE-B |
|---|---|---|---|
| Ce, % | 60 | 55 | 70 |
| Fe, % | 78 | 76 | 98 |

The efficiency of the utilization of the zeolite precursor was calculated. The results of which are shown in Table 5. As is shown in Table 5, the present process (used to produce EX-1) was more efficient at utilizing the ZSM-5 precursor than the wet impregnation method used to produce CE-A.

TABLE 5

| ZSM-5 Catalyst | EX-1 | CE-A | CE-B |
|---|---|---|---|
| Yield, % | 69 | 63 | 80 |

UV-Vis Characterization

Figure 5:
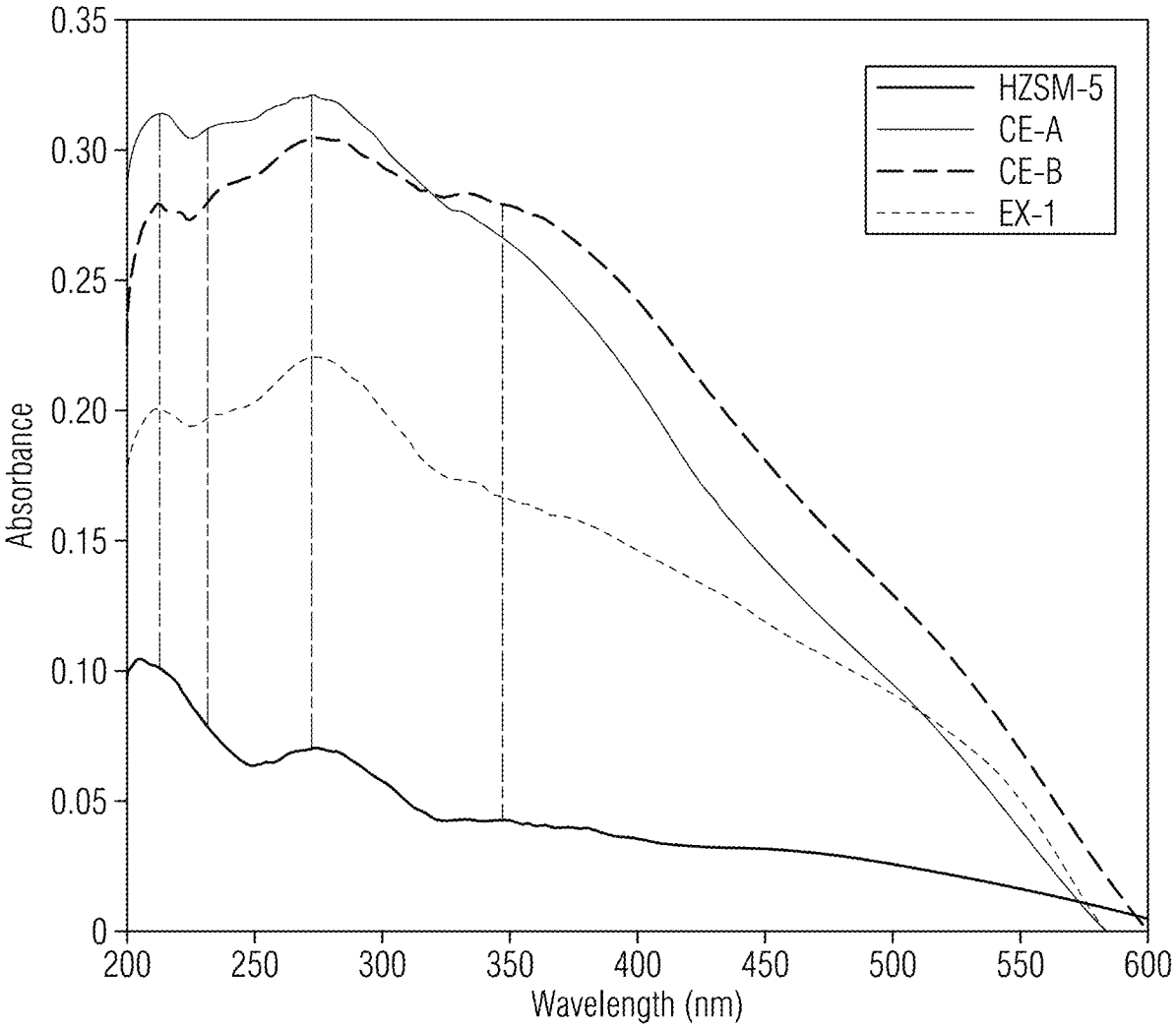
FIG. 5 graphically depicts an UV-Vis diffuse reflectance spectrum for a framework-substituted pentasil zeolite, according to one or more embodiments shown and described in the present disclosure.

To investigate the composition of different Ce and Fe species present in the precursor solution, UV-vis diffuse reflectance spectroscopy was performed according to known test methods. As shown in FIG. 5, the base HZSM-5 exhibited the adsorption bands at about 210 and 280 nm. There is no discernible peak for cerium oxide species in any of the zeolite samples, indicating that all the cerium in the samples is either monomeric or is present at concentrations that are undetectable using the UV-Vis diffuse reflectance spectroscopy method.

Samples CE-A and CE-B show absorption signals for the presence of oligomeric Fe species (~237 nm) and for the presence of monomeric Fe species (>290 nm), indicating the formation of both monomeric and oligomeric Fe species. However, the spectra of EX-1 showed only absorption signals of monomeric Fe (~237 nm), with no adsorption signals showing oligomeric Fe (>290 nm).

Catalyst Physical Characterization

The amount of Ce and Fe species on the prepared catalysts were measured by conducting inductively coupled plasma mass spectrometry (ICP-MS) using known methods, the results of which are presented in Table 6.

Figure 3:
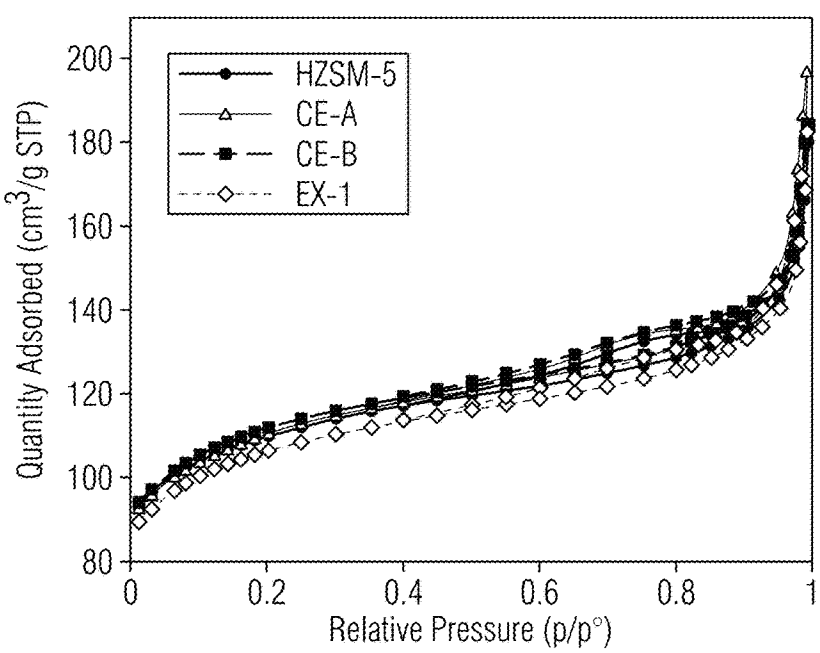
FIG. 3 graphically depicts a nitrogen adsorption/desorption spectrum for a framework-substituted pentasil zeolite, according to one or more embodiments shown and described in the present disclosure.

FIG. 3 depicts $N_2$ adsorption-desorption isotherms and pore-size distributions for the base ZSM-5 zeolite, CE-A, CE-B, and EX-1. The isotherms of all catalysts are of type I reflecting their uniform microporous structure. The shapes of the isotherms and pore-size distribution did not change significantly after cerium and iron modification irrespective of preparation method. The adsorption-desorption isotherms overlap at a low relative pressure ($p/p^{\circ}\approx 0.4$), suggesting that monolayer-multilayer adsorption occurs. The start of the hysteresis loop indicates capillary condensation inside the pores, and the filling of the pores corresponds to its end. The loading of Ce and Fe metals by solid-state ion exchange method resulted in a slight decrease in the surface area and increase in porosity and pore volume induced by the inclusion of metal(s) species inside the support. However, other preparation methods show the comparative surface area and porosity, indicating that metals modifications have limited impact on the physicochemical properties of the base ZSM-5 catalyst (Table 5).

TABLE 6

| Catalyst | Preparation Method | Surface Area ($m^2g^{-1}$) | PS (nm) | PV ($cm^3g^{-1}$) | Metal Loading (wt. %) Ce | Metal Loading (wt. %) Fe |
|---|---|---|---|---|---|---|
| HZSM-5 | starting zeolite | 342 | 5.05 | 0.170 | — | — |
| CE-A | Wet Co-impregnation | 346 | 5.46 | 0.201 | 0.11 | 0.38 |
| CE-B | Liquid Ion Exchange | 350 | 4.88 | 0.177 | 0.14 | 0.49 |
| EX-1 | Solid State Ion Exchange | 333 | 5.22 | 0.179 | 0.12 | 0.39 |

Figure 6:
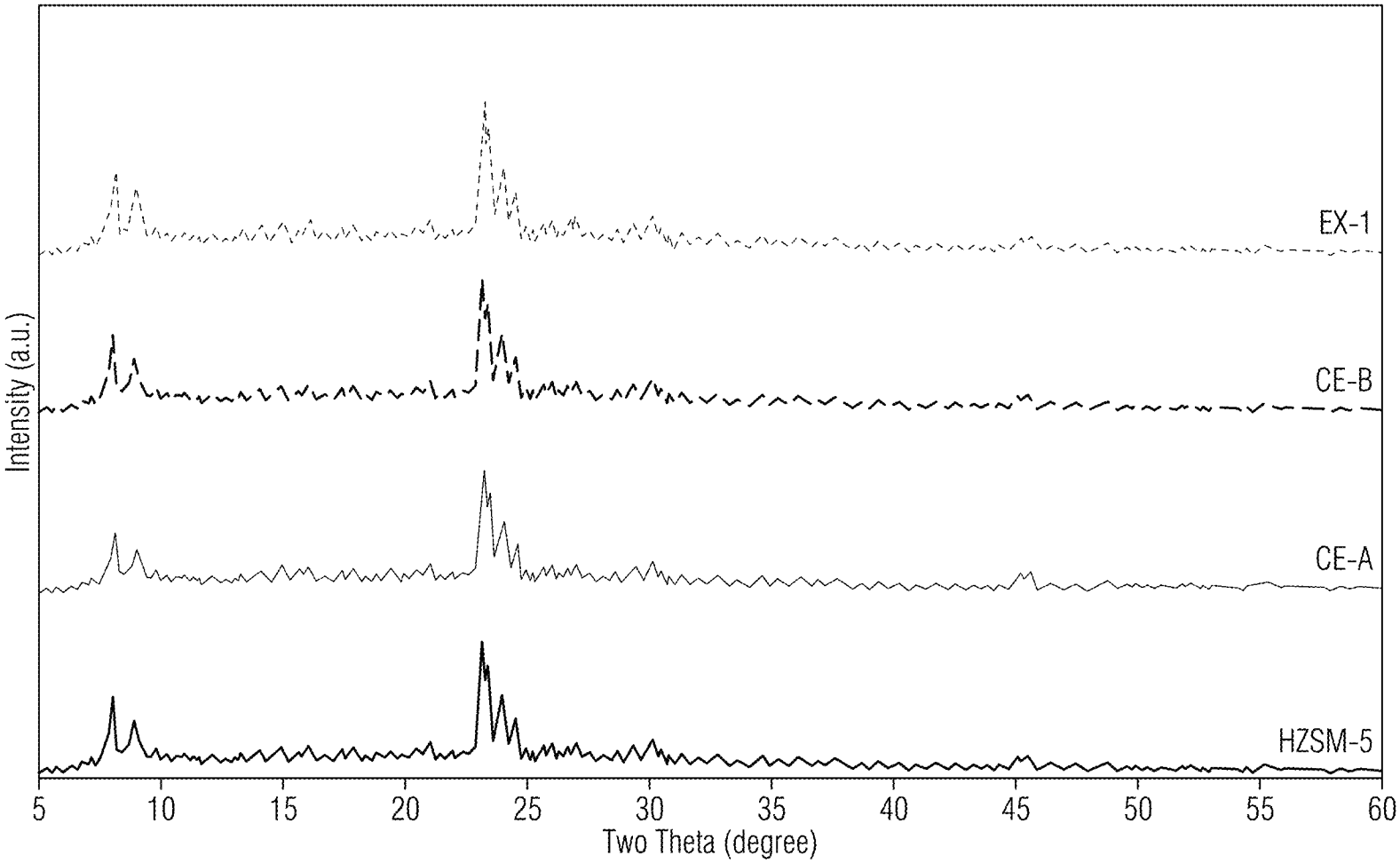
FIG. 6 graphically depicts an x-ray diffraction (XRD) spectrum for a framework-substituted pentasil zeolite, according to one or more embodiments shown and described in the present disclosure.

X-ray diffraction (XRD) testing was performed on each of the above samples according to known testing methods. The XRD spectra of each sample are shown in FIG. 6. All of samples CE-A, CE-B, and EX-1 exhibited diffraction patterns that were similar to those of the unmodified zeolite, showing the typical ZSM-5 structure at $2\theta$=7-10° and 20-24° and no additional phases for metal oxide, indicating the high dispersion of Ce and Fe species for all samples. It has been observed that the XRD crystallinity of zeolites remains almost the same even after varying the preparation method.

Figure 7:
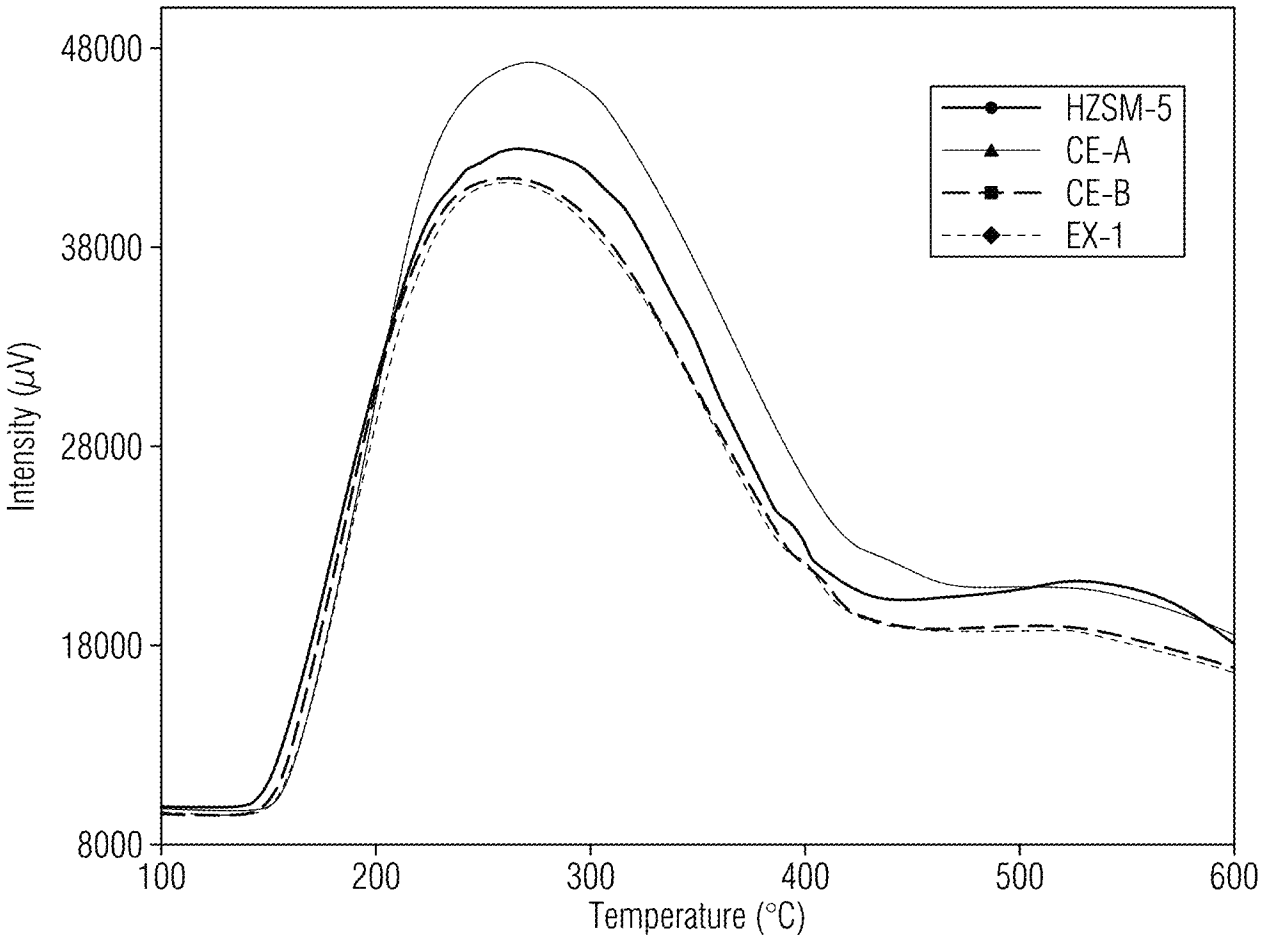
FIG. 7 graphically depicts a nitrogen temperature programmed desorption ($NH_3$-TPD) profile for a framework-substituted pentasil zeolite, according to one or more embodiments shown and described in the present disclosure.

Ammonia temperature-programmed desorption ($NH_3$-TPD) was performed on each of the samples. The $NH_3$-TPD spectra are shown in FIG. 7 are summarized in Table 7. The $NH_3$-TPD profiles of the starting ZSM-5 show two clear peaks at around 271° C. and 532° C. that correspond to the weak and strong acid sites, respectively. The total acidity quantity of in sample CE-A was 0.365 mmol/g, which is approximately 15% of the acidity of starting HZSM-5 (0.318 mmol/g) (Table 8). The samples CE-B and EX-1 had slightly lower temperatures and acidity, particularly at weak acid sites, owing to the uniform distribution of monomeric Ce and Fe species over the zeolite support.

TABLE 7

| Catalyst | Amount $NH_3$ desorbed (mmol/g) I 100-400° C. | II Above 400° C. | Total |
|---|---|---|---|
| HZSM-5 | 0.287 | 0.031 | 0.318 |
| CE-A | 0.335 | 0.030 | 0.365 |
| CE-B | 0.279 | 0.031 | 0.310 |
| EX-1 | 0.271 | 0.032 | 0.303 |

Through field emission scanning electron microscopy (FESEM) and energy-dispersive X-ray spectroscopy (EDS), it was observed that the framework substituted ZSM-5 zeolite of Example EX-1 was comprised of a mixture of large crystallites with few small particles. The EDS analysis of the selected area on the framework substituted ZSM-5 zeolite of Example EX-1 indicated the uniform dispersion of the elements Si, Al, O, Ce, and Fc. This signified the homogeneous distribution of the elements within the framework at the surface of the framework of the framework substituted ZSM-5 zeolite.

Figure 8:
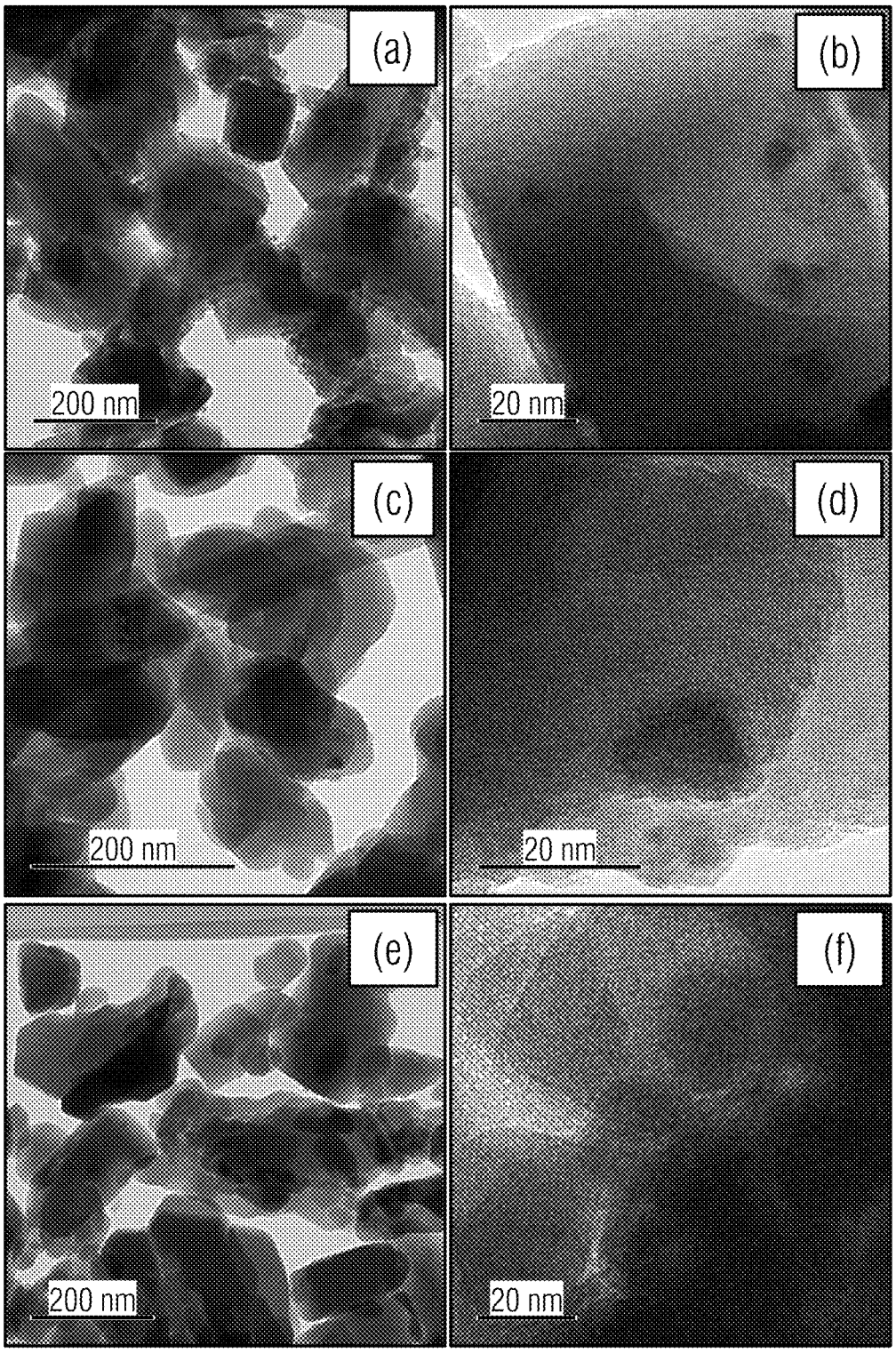
FIG. 8 depicts field emission transmission electron microscope (FE-TEM) images of each of the framework-substituted pentasil zeolites, according to one or more embodiments shown and described in the present disclosure.

As depicted in FIG. 8, high resolution transmission electron microscopy (HR-TEM) images were taken of each of the samples. (a) and (b) are images of CE-A. (c) and (d) are images of CE-B. (e) and (f) are images of EX-1. As can be seen from FIG. 8, each of the samples CE-A, CE-B, and EX-1 comprised discrete particles of size about 200 nm and an ordered microporous structure. The images show that while all three samples retained an ordered microstructure, EX-1 (f) retained a linear ordered microstructure.

Cracking Catalyst Evaluation

The framework-substituted pentasil zeolites of CE-A, CE-B, and EX-1 were blended with an equilibrium catalyst (E-Cat) to form a catalytic mixture. The E-Cat refers to a physical mixture of fresh and regenerated or aged catalyst that circulated within the FCC reactor. The ratio of E-Cat to framework-substituted pentasil zeolite was 75 wt. % E-Cat and 25 wt. % of the framework-substituted pentasil zeolites. Prior to activity testing, each of the catalytic mixtures was hydrothermally deactivated at 810° C. in 100% steam for 6 hours.

The catalytic mixtures were evaluated at atmospheric pressure in a fixed-bed reaction (FBR) system for steam catalytic cracking of crude oil such as AXL crude oil. The general make-up of the AXL crude oil is provided in Table 8. The cracked gaseous and liquid products were characterized by off-line gas chromatographic (GC) analysis using simulated distillation and naphtha analysis techniques.

Referring now to FIG. 9, the FBR system 300 for conducting the cracking catalyst evaluation is schematically depicted. AXL crude oil 301 was fed to a fixed-bed reactor 340 using a metering pump 311. A constant feed rate of 2 g/h of the AXL crude oil 301 was used. Water 302 was fed to the fixed bed reactor 340 using a metering pump 312. Water 302 was preheated using a preheater 321. A constant feed rate of 1 g/h of water 302 was used. Nitrogen 303 was used as a carrier gas at 65 mL/min. Nitrogen 303 was fed to the fixed bed reactor 340 using a Mass Flow Controller (MFC) 313. Nitrogen 303 was preheated using a preheater 322. Water 302 and Nitrogen 303 were mixed using a mixer 330 and the mixture was introduced to the fixed-bed reactor 340. Prior to entering the reactor tube, the AXL crude oil 301, water 302, and nitrogen 303 were preheated up to 250° C. in the pre-heating zone 342. The pre-heating zone 342 was preheated using line heaters 331. Crude oil 301 was introduced from the top of the reactor 240 through the injector 341 and mixed with steam in the top two-third of the reactor tube 340 before reaching the catalyst bed 344.

The catalyst bed 344 in the reactor tube 340 was moved a few centimeters down to allow more time for pre-heating of AXL crude oil 301 prior to contacting with the cracking catalyst in the catalyst bed 344. For each experiment, 1 gram (g) of cracking catalyst having a mesh size of 30-40 was placed at the center of the reactor tube 340, supported by quartz wool 343, 346 and a reactor insert 345. Quartz wool 343, 346 was placed both at the bottom and top of the catalyst bed 344 to keep it in position. The height of the catalyst bed 344 was 1-2 cm. The catalytic mixtures comprising CE-A, CE-B, and EX-1 were each used as the cracking catalyst in a different experiment.

Following steam deactivation, the crude oil hydrocarbon feed and the water/steam were introduced to the reaction tube of the FBR. The reaction was allowed to take place for 45-60 min, until steady state was reached. The mass ratio of steam to crude oil was 0.5 grams of steam per gram of crude oil. The crude oil was cracked at a cracking temperature of 675° C. and a weight ratio of catalyst to crude oil of 1:2. The residence time of the crude oil and the steam in the fixed bed reactor 340 was 10 seconds. The total time on stream for each individual experiment was 5 hours.

Figure 10:
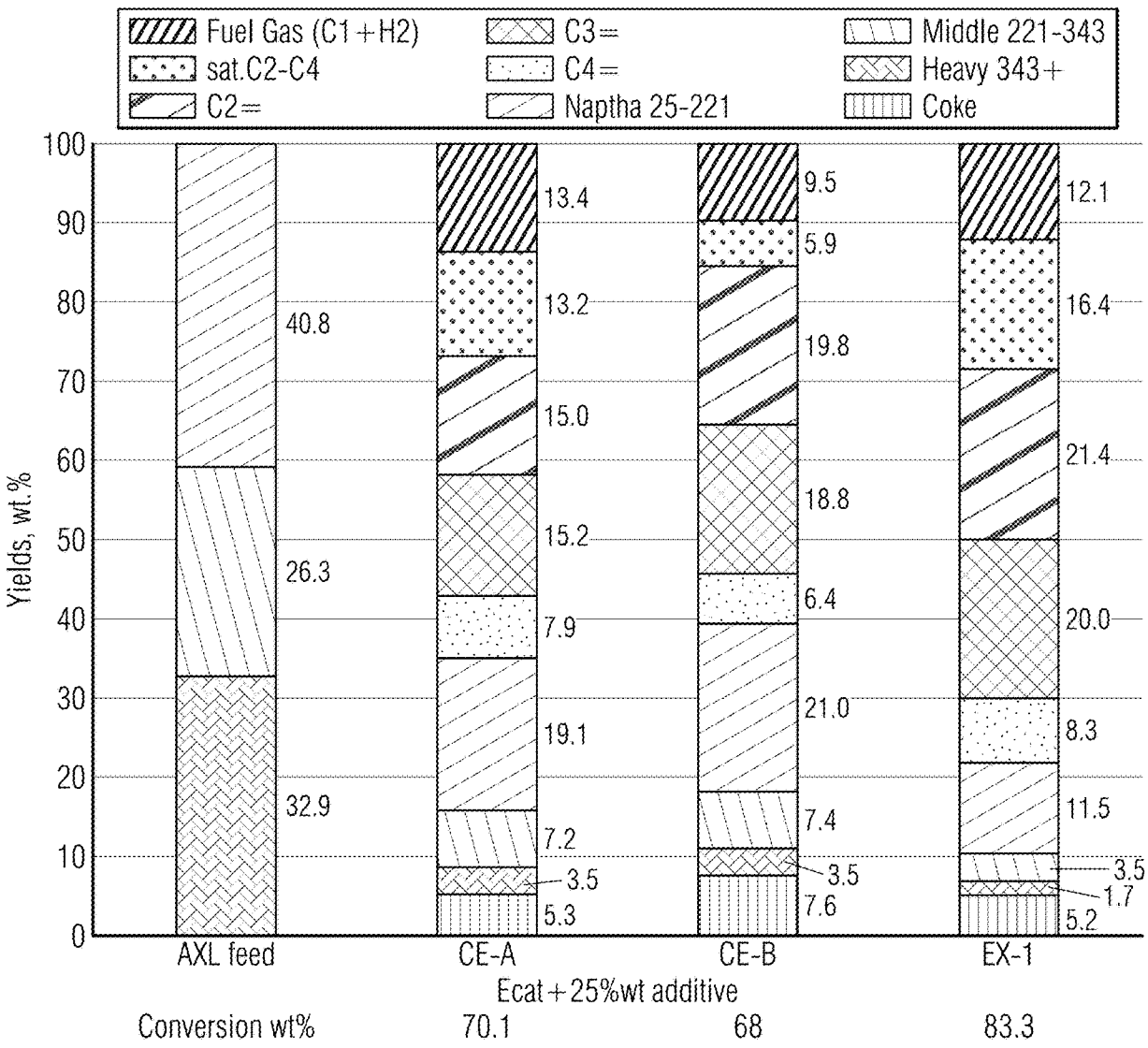
FIG. 10 graphically depicts product yields obtained from cracking an AXL crude oil with cracking catalysts of CE-A, CE-B, and EX-1, according to one or more embodiments shown and described in the present disclosure.

The cracking reaction product stream 345 was introduced to a gas-liquid separator 351. A Wet Test Meter 352 was placed downstream of the gas-liquid separator 351. The cracked gaseous products 361 and liquid products 362 were characterized by off-line gas chromatographic (GC) analysis using simulated distillation and naphtha analysis techniques. The reaction product streams from the cracking reaction were analyzed for yields of ethylene, propylene, and butylene. The yield analyses are depicted in FIG. 10 and provided numerically in Table 8.

TABLE 8

Effect of Loading Methodologies

| Stream | Feed | Effluent | Effluent | Effluent |
|---|---|---|---|---|
| Catalyst | — | CE-A | CE-B | EX-1 |
| Temperature (° C.) | — | 675 | 675 | 675 |
| Steam/Oil Weight Ratio | — | 0.5 | 0.5 | 0.5 |
| Residence Time (seconds) | — | 10 | 10 | 10 |
| Fuel Gas ($C_1$ & $H_2$) (wt. %) | — | 13.4 | 9.5 | 12.1 |
| Saturated $C_2$-$C_4$ (wt. %) | — | 13.2 | 5.9 | 16.4 |
| Ethylene (wt. %) | — | 15.0 | 19.8 | 21.4 |
| Propylene (wt. %) | — | 15.2 | 18.8 | 20.0 |
| Total Butenes (wt. %) | — | 7.9 | 6.4 | 8.3 |
| Naphtha (15° C.-221° C.) (wt. %) | 40.8 | 19.1 | 21.0 | 11.5 |
| Middle Distillate (221° C.-343° C.) (wt. %) | 26.3 | 7.2 | 7.4 | 3.5 |
| Heavy (343° C.+) (wt. %) | 32.9 | 3.5 | 3.5 | 1.7 |
| Coke (wt. %) | — | 5.3 | 7.6 | 5.2 |
| Total (wt. %) | 100 | 100 | 100 | 100 |
| Total Light Olefins (wt. %) | 0.0 | 38.1 | 45 | 49.7 |
| Total Conversion (%) | | 70.1 | 68.0 | 83.3 |

1. The yields in Table 8 are expressed in units of weight percent based on the total weight of the stream.

The steam enhanced catalytic cracking of AXL over EX-2 yielded the highest AXL conversion of 83.3%, the highest maximum conversion of the naphtha fraction (72%), and the lowest coke yield of 5.2%. Additionally, the CE-A showed the highest yield of light olefins. Therefore, the experimental results confirm that the present catalyst and preparation methods result in the best catalytic performance. Without being limited by theory, this is believed to be because the solid-state ion exchange (SSIE) method, employing no solvent, avoids the preparation of the precursor solution and drying process to remove the solvent, which could thus prevent the hydrolysis and subsequent agglomeration of Ce and Fe monomers in the precursor solution and the drying process, causes EX-1 to possess a maximum proportion of the active monomeric Ce and Fe species.

Figure 11:
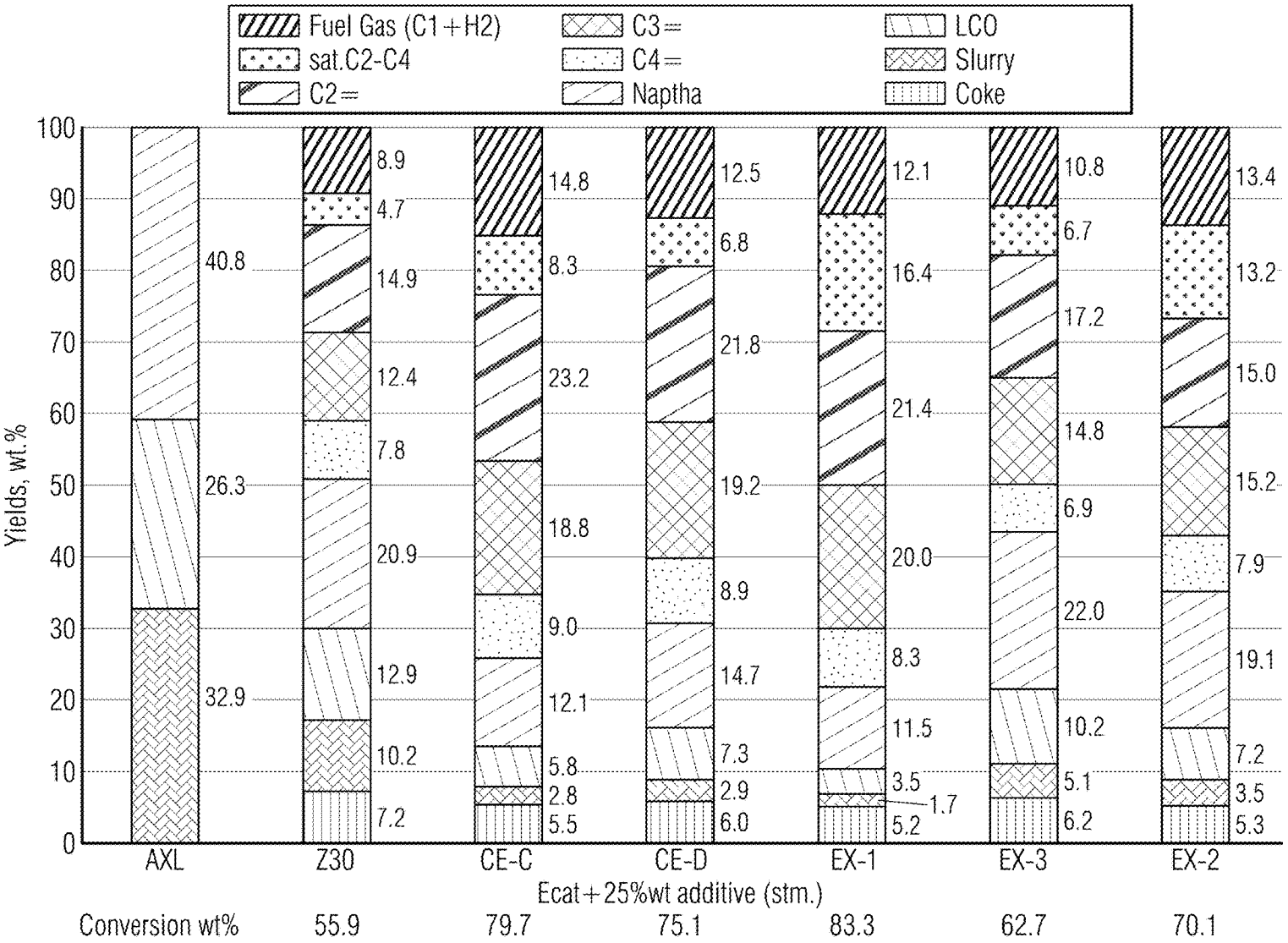
FIG. 11 graphically depicts product yields obtained from cracking an AXL crude oil with cracking catalysts of CE-C, CE-D, EX-1, EX-2, and EX-3, according to one or more embodiments shown and described in the present disclosure.
Figure 12:
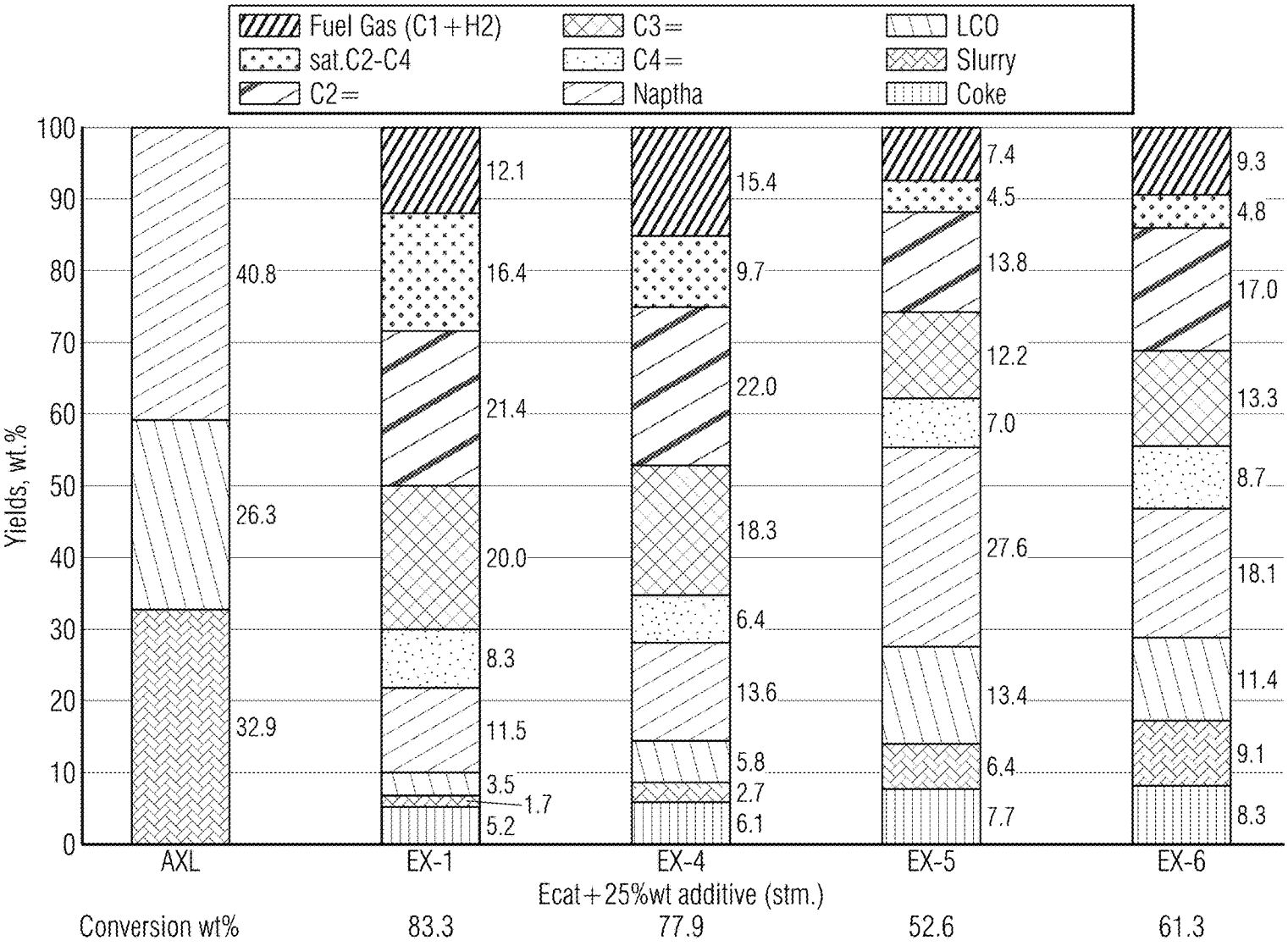
FIG. 12 graphically depicts product yields obtained from cracking an AXL crude oil with cracking catalysts of EX-1, EX-4, EX-5, and EX-6, according to one or more embodiments shown and described in the present disclosure.
Figure 13:
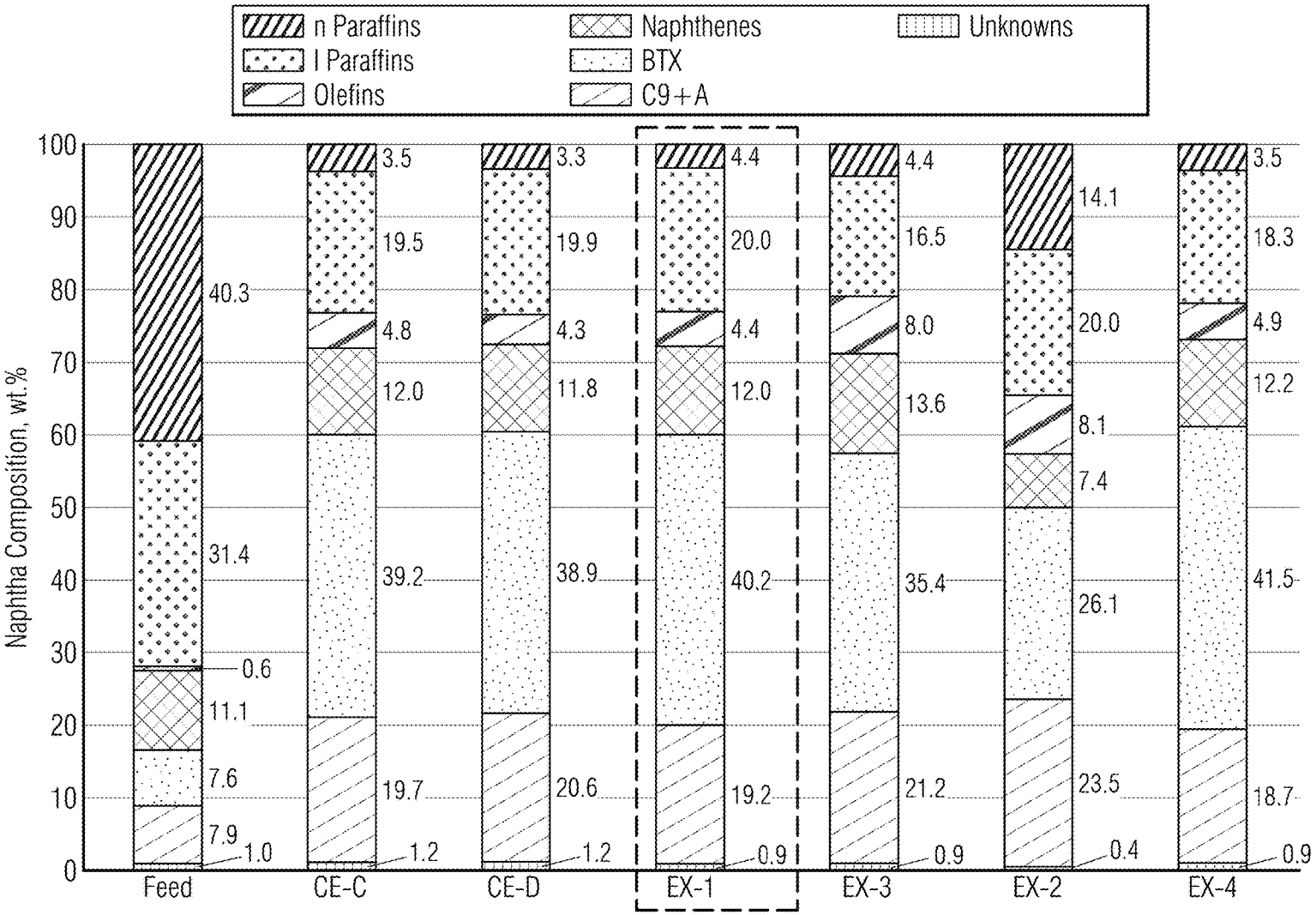
FIG. 13 graphically depicts product yields obtained from cracking an AXL crude oil with cracking catalysts of CE-C, CE-D, EX-1, EX-2, EX-3, and EX-4 according to one or more embodiments shown and described in the present disclosure.

The above catalyst evaluation experiments were repeated with comparative example CE-C, CE-D, and examples EX-1 to EX-6. The results of which are shown in FIG. 11, FIG. 12, and FIG. 13. As can be seen in the figures, the simultaneous loading of Ce and Fe provides the best yields. Additionally, 0.2 wt. % of Ce and 0.5 wt. % of Fe provided the best activity and yields of the concentrations tested.

In a first aspect, a method for converting hydrocarbons in a hydrocarbon stream may comprise: contacting the hydrocarbon stream with steam and a catalyst system under steam enhanced catalytic cracking conditions to produce an effluent comprising olefins, wherein: the catalyst system may comprise a framework-substituted pentasil zeolite; the framework-substituted pentasil zeolite may have a modified pentasil framework, the modified pentasil framework may comprise a pentasil aluminosilicate framework wherein a portion of framework aluminum atoms of the pentasil aluminosilicate framework may be substituted with Ce atoms and Fe atoms; and at least a portion of the Fe atoms may be monomeric.

In a second aspect, in conjunction with the first aspect, at least a portion of the Ce atoms may be monomeric.

In a third aspect, in conjunction with aspects 1 or 2, the framework-substituted pentasil zeolite may comprise from 0.2 to 1.0 wt. % of Ce atoms and from 0.2 to 0.5 wt. % of Fe atoms, as calculated on an oxide basis, based on the total mass of the framework-substituted pentasil zeolite.

In a fourth aspect, in conjunction with any one of aspects 1 to 3, a ratio of Ce atoms to Fe atoms may be from 1:5 to 3:5.

In a fifth aspect, in conjunction with any one of aspects 1 to 4, the framework-substituted pentasil zeolite may have: (a) a specific surface area of 200 $m^2/g$ to 600 $m^2/g$; (b) a molar ratio of $SiO_2$ to $Al_2O_3$ from 10 to 200; and (c) a pore volume from 0.1 $cm^3/g$ to 0.6 $cm^3/g$.

In a sixth aspect, in conjunction with any one of aspects 1 to 5, at least 80 mol. % of the Ce atoms may be monomeric.

In a seventh aspect, in conjunction with aspect 6, at least 99 mol. % of the Ce atoms may be monomeric.

In an eighth aspect, in conjunction with any one of aspects 1 to 7, at least 80 mol. % of the Fe atoms may be monomeric.

In a ninth aspect, in conjunction with aspect 8, at least 99 mol. % of the Fe atoms may be monomeric.

In a tenth aspect, in conjunction with any one of aspects 1 to 9, the steam enhanced catalytic cracking conditions may comprise a steam to hydrocarbon ratio of from 0.2 to 0.8.

In an eleventh aspect, in conjunction with any one of aspects 1 to 10, the steam enhanced catalytic cracking conditions may comprise a reaction temperature from 450° C. to 750° C., a reaction pressure from 1 bar to 5 bar, and a residence time from 0.5 seconds to 1000 seconds.

In a twelfth aspect, in conjunction with any one of aspects 1 to 11, the framework-substituted pentasil zeolite may be prepared by a solid-state ion exchange process in which the framework aluminum atoms are substituted for Ce atoms and Fe atoms using solid state ion exchange.

In a thirteenth aspect, in conjunction with aspect 12, the framework aluminum atoms may be simultaneously substituted for Ce and Fe atoms using solid state ion exchange.

In a fourteenth aspect, in conjunction with any one of aspects 1 to 13, the catalyst system may comprise particles with a particle size of from 150 μm to 200 μm.

In a fifteenth aspect, in conjunction with any one of aspects 1 to 14, the hydrocarbon stream may comprise crude oil.

In a sixteenth aspect, in conjunction with any one of aspects 1 to 15, the framework-substituted pentasil zeolite may be prepared by a method comprising: combining a pentasil aluminosilicate framework with an iron precursor and a cerium precursor, thereby forming a first mixture; and calcining the first mixture, thereby forming the framework-substituted pentasil zeolite.

In a seventeenth aspect, in conjunction with aspect 16, calcining the first mixture may comprise exposing the first mixture to air at a temperature of at least 500° C., for at least 1 hr.

In an eighteenth aspect, in conjunction with any one of aspects 16-17, the first mixture may be a dry mixture.

In a nineteenth aspect, in conjunction with any one of aspects 1 to 18, the effluent may comprise at least 46 wt. % of light olefins.

In a twentieth aspect, in conjunction with any one of aspects 1 to 19, the method may further comprise combining a pentasil aluminosilicate framework with an iron precursor and a cerium precursor, thereby forming a first mixture; and calcining the first mixture, thereby forming the framework-substituted pentasil zeolite.

What is claimed is:

1. A method for converting hydrocarbons in a hydrocarbon stream, the method comprising contacting the hydrocarbon stream with steam and a catalyst system under steam enhanced catalytic cracking conditions to produce an effluent comprising olefins, where:

the catalyst system comprises a framework-substituted pentasil zeolite comprising from 0.2 to 1.0 wt. % Ce atoms and from 0.2 to 0.5 wt. % Fe atoms, as calculated on an oxide basis, based on the total mass of the framework-substituted pentasil zeolite;

the framework-substituted pentasil zeolite has a modified pentasil framework, the modified pentasil framework comprising a pentasil aluminosilicate framework in which a portion of framework aluminum atoms of the pentasil aluminosilicate framework are substituted with Ce atoms and Fe atoms using solid state ion exchange;

at least 80 mol. % of the Fe atoms are monomeric; and the steam enhanced catalytic cracking conditions comprise:

a steam to hydrocarbon ratio of from 0.2 to 0.8;

a reaction temperature from 450° C. to 750° C.;

a reaction pressure from 1 bar to 5 bar; and a residence time from 0.5 seconds to 1000 seconds.

2. The method of claim 1, where at least a portion of the Ce atoms are monomeric.

3. The method of claim 1, where a ratio of Ce atoms to Fe atoms is from 1:5 to 3:5.

4. The method of claim 1, where the framework-substituted pentasil zeolite has:

(a) a specific surface area of 200 $m^2/g$ to 600 $m^2/g$;

(b) a molar ratio of $SiO_2$ to $Al_20_3$ from 10 to 200; and (c) a pore volume from 0.1 $cm^3/g$ to 0.6 $cm^3/g$.

5. The method of claim 1, where at least 80 mol. % of the Ce atoms are monomeric.

6. The method of claim 5, where at least 99 mol. % of the Ce atoms are monomeric.

7. The method of claim 1, where at least 99 mol. % of the Fe atoms are monomeric.

8. The method of claim 1, where the framework aluminum atoms are simultaneously substituted for Ce and Fe atoms using solid state ion exchange.

9. The method of claim 1, where the catalyst system comprises particles with a particle size of from 150 m to 200 m.

10. The method of claim 1, where the hydrocarbon stream comprises crude oil.

11. The method of claim 1, where the framework-substituted pentasil zeolite is prepared by a method comprising:

combining a pentasil aluminosilicate framework with an iron precursor and a cerium precursor, thereby forming a first mixture; and calcining the first mixture, thereby forming the framework-substituted pentasil zeolite.

12. The method of claim 11, where calcining the first mixture comprises exposing the first mixture to air at a temperature of at least 500 for at least 1 hr.

13. The method of claim 11, where the first mixture is a dry mixture.

14. The method of claim 1, where the effluent comprises at least 46 wt. % of light olefins.

15. The method of claim 1, wherein the framework-substitution atoms of the pentasil zeolite consist of Fe atoms and Ce atoms.

* * * * *